US006612467B2

(12) United States Patent
Wertheim

(10) Patent No.: US 6,612,467 B2
(45) Date of Patent: Sep. 2, 2003

(54) TAMPER-PROOF CHEMICAL DISPENSING DEVICE FOR HIGH SECURITY ENVIRONMENTS

(75) Inventor: Mark S Wertheim, Danville, CA (US)

(73) Assignee: Keene Sanitary Supply, Inc., San Leandro, CA (US)

( * ) Notice: Subject to any disclaimer, the term of this patent is extended or adjusted under 35 U.S.C. 154(b) by 0 days.

(21) Appl. No.: 09/922,963

(22) Filed: Aug. 3, 2001

(65) Prior Publication Data

US 2002/0050302 A1 May 2, 2002

Related U.S. Application Data

(60) Provisional application No. 60/262,733, filed on Jan. 19, 2001.

(51) Int. Cl.[7] ..... B67D 5/00

(52) U.S. Cl. ..... 222/153.13; 222/135; 222/153.02; 222/153.03; 222/153.14; 222/182; 222/538

(58) Field of Search ..... 222/129, 135, 222/153.01, 153.02, 153.03, 153.13, 153.14, 173, 182, 183, 538, 540, 566, 572, 573, 575

(56) References Cited

U.S. PATENT DOCUMENTS

| | | | | | |
|---|---|---|---|---|---|
| 932,386 | A | * | 8/1909 | Gross | 222/129.2 |
| 1,075,999 | A | | 10/1913 | Abramovitz | |
| 1,291,566 | A | | 1/1919 | Lewis | |
| 1,366,529 | A | * | 1/1921 | Frick | 194/300 |
| 1,421,765 | A | | 7/1922 | Cunningham | |
| 1,715,939 | A | * | 6/1929 | Milestone | 222/36 |
| 2,000,556 | A | * | 5/1935 | Brady | 141/174 |
| 2,063,171 | A | * | 12/1936 | Kucher | 222/146.1 |
| 2,512,395 | A | * | 6/1950 | Sundberg | 222/182 |
| 2,572,541 | A | * | 10/1951 | Thompson et al. | 222/129.3 |
| 2,643,669 | A | * | 6/1953 | Logan | 137/382 |
| 3,127,065 | A | * | 3/1964 | Stevenson | 222/164 |
| 3,195,777 | A | * | 7/1965 | Hart | 222/181.2 |
| 3,861,568 | A | | 1/1975 | Morris et al. | |
| 3,940,019 | A | * | 2/1976 | Kross et al. | 222/30 |
| 3,945,603 | A | | 3/1976 | Fraser | |
| 4,120,181 | A | | 10/1978 | Stubbings | |
| 4,158,426 | A | | 6/1979 | Frohbieter | |
| 4,911,212 | A | | 3/1990 | Burton | |
| 5,060,689 | A | | 10/1991 | Csaszar et al. | |
| 5,064,097 | A | * | 11/1991 | Brog et al. | 222/129 |
| 5,088,621 | A | | 2/1992 | Thompson et al. | |
| 5,255,820 | A | | 10/1993 | Thomas | |
| 5,333,467 | A | | 8/1994 | Pearl, II et al. | |
| 5,344,074 | A | | 9/1994 | Spriggs et al. | |
| 5,351,875 | A | | 10/1994 | Rhine et al. | |
| 5,584,327 | A | | 12/1996 | Thomas et al. | |
| 5,651,398 | A | | 7/1997 | Decker et al. | |
| 6,302,163 | B1 | * | 10/2001 | Zeigler | 141/20 |

FOREIGN PATENT DOCUMENTS

| | | |
|---|---|---|
| DE | 2558509 | 5/1976 |
| GB | 2173476 A | 10/1976 |

OTHER PUBLICATIONS

Photographs of mixing nozzle by Advance Chemical Company, Huntington Beach, CA.

* cited by examiner

*Primary Examiner*—J. Casimer Jacyna
(74) *Attorney, Agent, or Firm*—Thomas F. Lebens; Fitch, Even, Tabin & Flannery

(57) ABSTRACT

The present invention can be characterized as a tamper-proof apparatus for dispensing a liquid comprising a chamber for storing the liquid; an outlet in the chamber for dispensing the liquid; and an outlet shield protecting the outlet from damage. The present invention can be characterized as a method of dispensing liquid from a dispensing unit comprising storing a liquid in a supply reservoir within a locked chamber; applying pressure to a plate within the locked chamber through a hole in a top of the locked chamber; and dispensing the liquid through an outlet in the locked chamber, the outlet being covered by an outlet shield to protect the outlet from damage.

29 Claims, 13 Drawing Sheets

Channel: S21
Rotation: Elevation

DUT Description:
300201
Pol: Horizontal

RangeStar BC#2
Automated Antenna
and Cellphone
Measurment System

| Freq (MHz) | Trace | Beam Deg | Peak dB | Freq (MHz) | Trace | Beam Deg | Peak dB |
|---|---|---|---|---|---|---|---|
| 890.00 | ——— | +3.63 | +0.16 | 936.00 | — — | -1.07 | +1.04 |
| 900.00 | ——— | +3.63 | +0.61 | 948.00 | — — | -1.07 | +0.94 |
| 912.00 | ——— | +3.63 | +1.01 | 960.00 | — — | -5.76 | +0.03 |
| 924.00 | ——— | -1.07 | +1.21 | | | | |

Channel: S21
Rotation: Elevation

DUT Description:
DB 300201
Pol: Horizontal

RangeStar BC#2
Automated Antenna
and Cellphone
Measurment System

| Freq (MHz) | Trace | Beam Deg | Peak dB | Freq (MHz) | Trace | Beam Deg | Peak dB |
|---|---|---|---|---|---|---|---|
| 1850.00 | ——— | +31.74 | +0.82 | 1923.00 | — — | +31.74 | +1.74 |
| 1880.00 | ——— | +31.74 | +1.07 | 1930.00 | — — | +36.43 | +0.71 |
| 1910.00 | ——— | +36.43 | +1.79 | 1960.00 | — — | +36.43 | +2.73 |
| 1917.00 | ——— | +36.43 | +1.85 | 1990.00 | — — | +36.43 | +1.82 |

TAMPER-PROOF CHEMICAL DISPENSING DEVICE FOR HIGH SECURITY ENVIRONMENTS

This patent application claims priority under 35 U.S.C. §119(e) to U.S. Provisional Application No. 60/262,733 for TAMPER-PROOF CHEMICAL DISPENSING DEVICE FOR HIGH SECURITY ENVIRONMENTS, by Wertheim, filed Jan. 19, 2001. This patent application relates to and expressly incorporates herein by reference U.S. patent application Ser. No. 09/828,554 for TAMPER-PROOF CHEMICAL DISPENSING DEVICE FOR HIGH SECURITY ENVIRONMENTS, by Wertheim, filed Apr. 5, 2001, U.S. Provisional Patent Application No. 60/262,733 for TAMPER-PROOF CHEMICAL DISPENSING DEVICE FOR HIGH SECURITY ENVIRONMENTS, by Wertheim, filed Jan. 19, 2001, and, U.S. Provisional Patent Application No. 60/194,811, for TAMPER-PROOF CHEMICAL DISPENSING DEVICE FOR HIGH SECURITY ENVIRONMENTS, by Wertheim, filed Apr. 5, 2000.

BACKGROUND OF THE INVENTION

The present invention is directed to methods and apparatus for dispensing liquids, and more particularly is directed to dispensing liquid from a tamper-proof container. More specifically the present invention relates to dispensing cleaning products from a tamper-proof container suitable for use in jail, correctional facility, school, public facility, or any other location subject to abuse or vandalism.

Liquid and soap dispensers have been used for many years. These dispensers are used in a number of applications, including: soap dispensers in restrooms, beverage dispensers, liquid dispensers at gas stations, etc. For example U.S. Pat. No. 4,911,212 discloses a device used to dispense water or other liquids into a reusable container. U.S. Pat. No. 5,088,621 discloses a dispenser to be used at a gas station. The '621 patent discloses an apparatus used to dispense a predetermined amount of liquid from a reservoir mounted on the dispenser. These devices although suitable in many applications do not provide a tamper-proof dispenser.

Therefore there is a need for a tamper-proof dispenser that can be used in correctional facilities, prisons, jails, public restrooms, schools and other facilities or institutions where the dispenser is susceptible to abuse or vandalism.

SUMMARY OF THE INVENTION

The present invention advantageously addresses the needs above as well as other needs by providing a tamper-proof apparatus for dispensing liquid including a chamber, a supply reservoir, a plunger, a output tube, an outlet, an outlet shield, a lockable door, a lockable flap, a hole in the top of the chamber and a horizontal plate.

The present invention can be characterized in one embodiment as a tamper-proof apparatus for dispensing a liquid comprising a chamber; a lockable door making up at least a part of one side of the chamber; a supply reservoir within the chamber; a plunger coupled to the supply reservoir; a hole in the chamber; and a actuator coupled within the chamber adjacent to the hole; wherein the actuator is within the chamber, such that if pressure is applied to the actuator the plunger is actuated.

In another embodiment the present invention can be characterized as a tamper-proof apparatus for dispensing a liquid comprising a chamber for storing the liquid; an outlet in the chamber for dispensing the liquid; and an outlet shield protecting the outlet from damage.

In yet another embodiment the present invention can be characterized as a method of dispensing liquid from a dispensing unit comprising storing a liquid in a supply reservoir within a lockable chamber; applying pressure to an actuator within the lockable chamber through a hole in the lockable chamber; and dispensing the liquid through an outlet in the lockable chamber, the outlet being covered by an outlet shield to protect the outlet from damage.

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Figure 1:
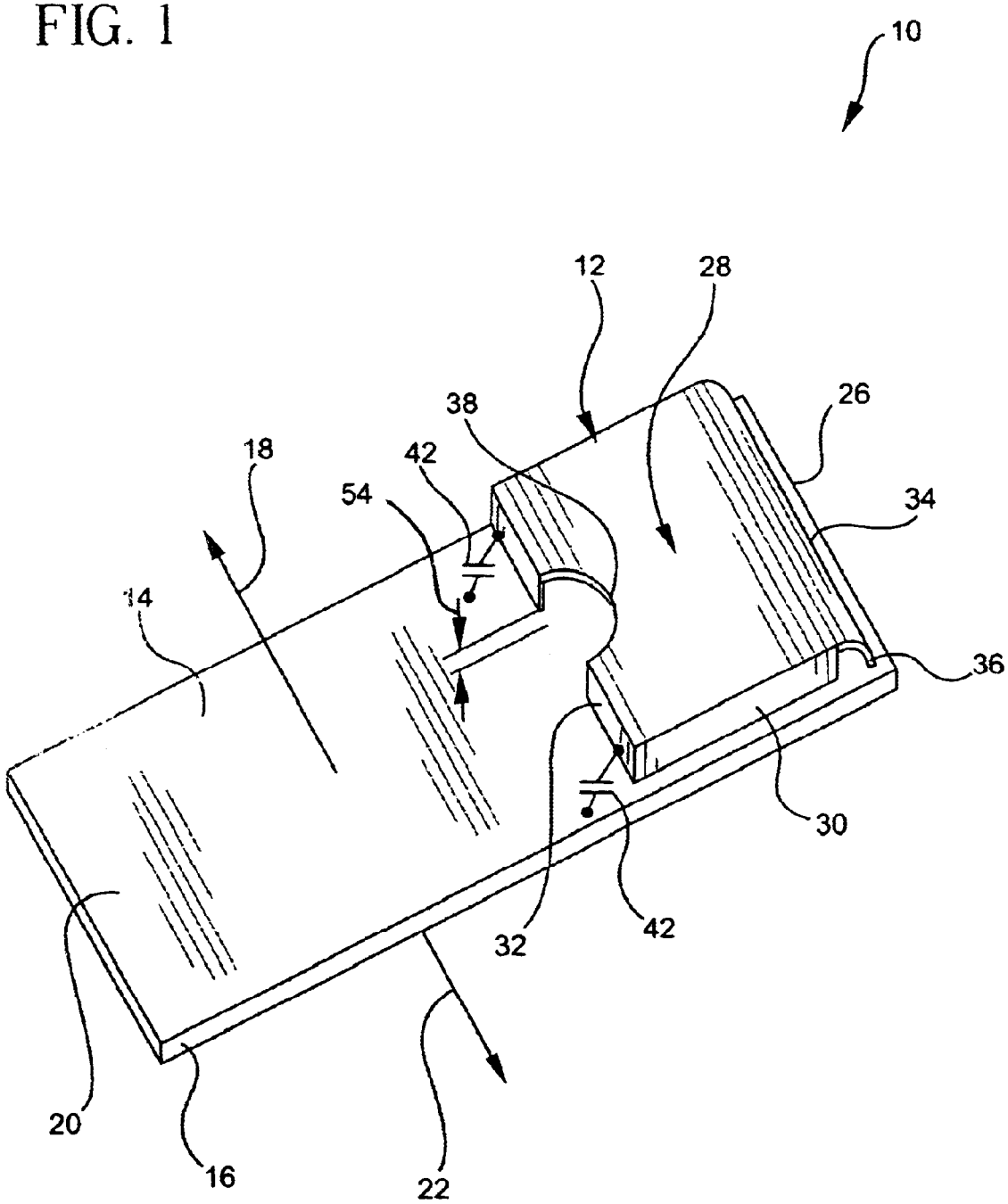
FIG. 1 is a perspective view of a dispensing unit for use with a liquid, such as soap and other cleaning or chemical materials.

Referring first to FIG. 1 shown is a perspective view of a dispensing unit 10 for use with a liquid, such as soap and other cleaning or chemical materials. Shown is the dispensing unit 10, a supply reservoir 12, an output hose 14, a lockable door 16, a door frame 18, an overhang 20, a first door hasp 22, a second door hasp 24, a door hinge 26, a top 28, a base 30, a lockable flap 32, a flap hole 34, a top hasp 36, a side hasp 38, a flap hinge 40, a door lock 52, and a flap lock 42.

Figure 7:
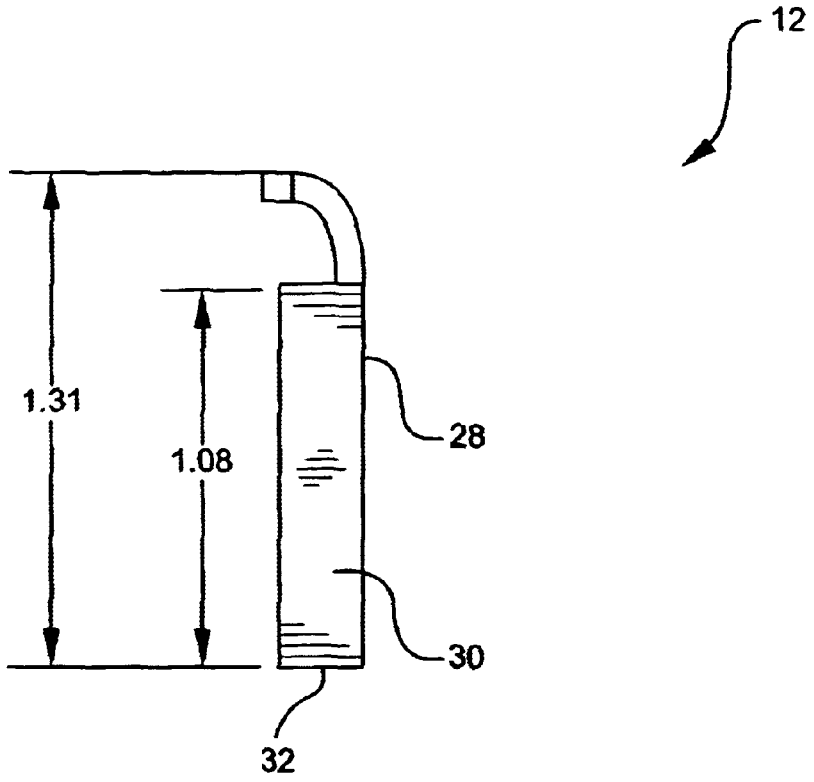
FIG. 7 is a top view of the hinge in FIG. 3 the hinge being recessed behind the top of the dispensing unit.

The dispensing unit 10 has the lockable door 16 on the front. Above the lockable door 16 is the overhang 20, further described with reference to FIG. 2. The lockable door 16 is attached to the dispensing unit 10 by the door hinge 26, which is recessed such that a hinge pin 78, shown in FIG. 7, is covered by the top 28 of the dispensing unit 10 or the base 30 of the dispensing unit 10. Advantageously, the lockable door 16 and the overhang 20 could also be positioned on the side of the dispensing unit 10.

Shown is the lockable door 16 in an open position, such that there is access to the supply reservoir 12. The flap 32 is shown in the closed position, such that the dispensing unit 10 cannot be used. The flap 32 is locked in the closed position to the top hasp 36 with the flap lock 42.

The operation and function of the supply reservoir 12 and output hose 14 will be further described with reference to FIGS. 2 and 3. The operation and function of the flap 32 will be further described with reference to FIGS. 4, 5, and 8.

Figure 2:
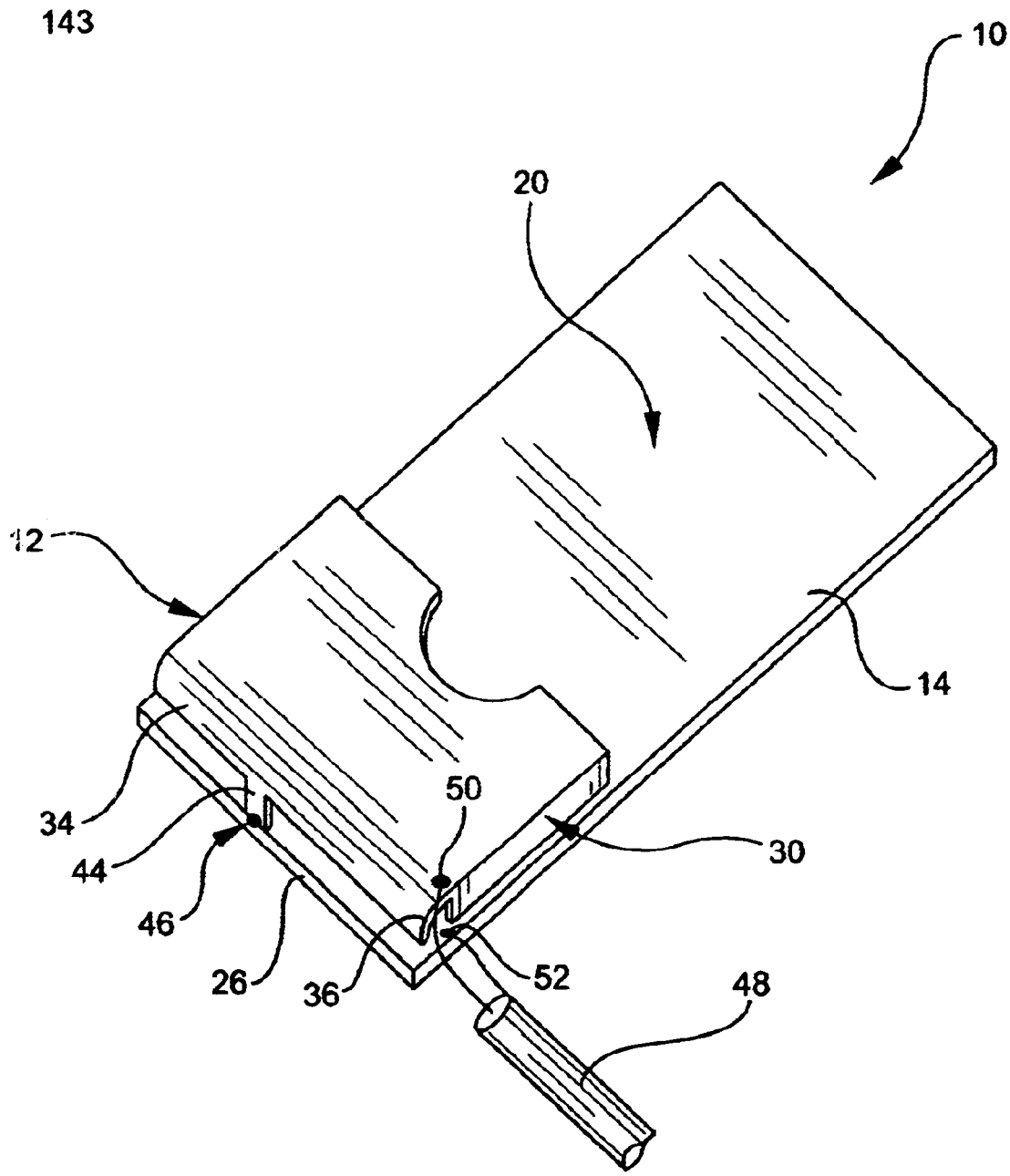
FIG. 2 is a side partial cross-sectional view of the dispensing unit of FIG. 1.

Referring to FIG. 2 shown is a side partial cross-sectional view of the dispensing unit 10 of FIG. 1. Shown is the dispensing unit 10, the overhang 20, the output hose 14, an outlet 44, a plunger 46, a supply reservoir cap 48, the supply reservoir 12, a horizontal plate 50, the door lock 52, the first door hasp 22, the second door hasp 24, the flap hinge 40, the flap 32, the top hasp 36, the side hasp 38, the flap hole 34, and the flap lock 42.

The supply reservoir 12 is contained within the dispensing unit 10 to protect it from vandalism or being damaged. The supply reservoir cap 48 is screwed on the top of the supply reservoir 12. The plunger 46 goes through a hole in the supply reservoir cap 48 and down into the supply reservoir 12. The supply reservoir 12, the supply reservoir cap 48, and the plunger 46 are commonly know in the art. The output hose 14 is coupled to the plunger 46 at one end and to the outlet 44 at the other end. The outlet 44 is a hole in the overhang 20. Advantageously, the outlet 44 can be a metal feed-through to which the output hose 14 is coupled. Shown is the flap 32 locked in the open position to the side hasp 38. This allows the dispensing unit 10 to be operated.

The overhang 20 is above the lockable door 16 on the front of the dispensing unit 10. The outlet 44, preferably a metal feed-through, is coupled to the output hose 14. The outlet 44 comes through the overhang 20 at the front of the dispensing unit 10 above the lockable door 16. While the overhang 20 extends the width of the dispensing unit 10, the overhang 20 could also be less than or greater than the width of the dispensing unit 10.

Figure 3:
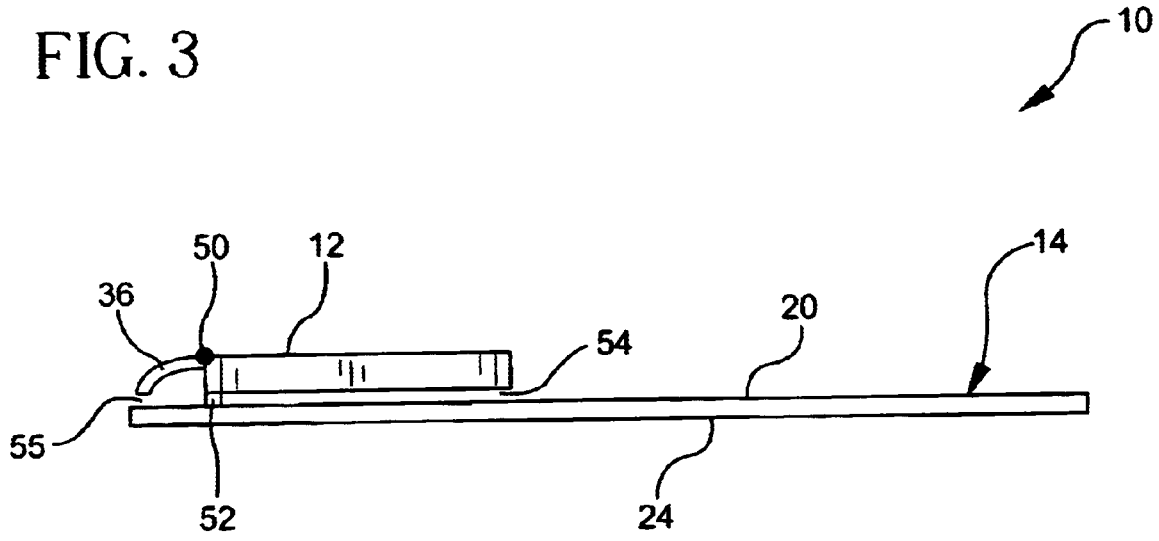
FIG. 3 is a front partial cross-sectional view of the dispensing unit of FIG. 1.

Referring to FIG. 3 shown is a partial front cross-sectional view of the dispensing unit 10 of FIG. 1. Shown is the dispensing unit 10, the overhang 20, the output hose 14, the flap hinge 40, the flap 32, the side hasp 38, the top hasp 36, the lockable door 16, the first door hasp 22, the door hinge 26, the supply reservoir 12, the supply reservoir cap 48, the plunger 46, the horizontal plate 50, a first security screw 54, a second security screw 56, a first spacer 58, a second spacer 60, a first nut 62, a second nut 64, the outlet 44, and the door lock 52.

A security screw, e.g., a prison screw, is a screw that requires a special tool to remove it from the nut. Because the special tool is required there is much less of a chance the screw can be removed, preventing the dispensing unit 10 from being dismantled and preventing the screw from being furnished into a weapon. A prison screw is a one type of security screw. Prison screws are a screws that comprise a hexagonal indentation in their upper surface or head, and further include a pin located in a center of the hexagonal indentation, such that they cannot be removed with an ordinary hexagonal wrench, but rather require a special tool, such as a hexagonal wrench with a center bore at one end, so as to accommodate the pin located in the center of the hexagonal indentation, and thereby allow insertion of the special tool to be inserted into the hexagonal indentation, so that it can engage such indentation and thereby allow the prison screw to be rotated by the special tool, and thereby inserted or removed, i.e., screwed in or unscrewed.

The top 28 of the dispensing unit 10 has the first security screw 54, the second security screw 56, a third security screw 68, and a fourth security screw 70 through it. The first security screw 54 goes through the horizontal plate 50 and through the first spacer 58. The first security screw 54 is then coupled to the first nut 62. The second security screw 56, the third security screw 68, and the fourth security screw 70 are similarly configured.

The horizontal plate 50 rests on top of the plunger 46. Shown is the horizontal plate 50 depressed, such that it is on top of the first spacer 58, the second spacer 60, a third spacer, and a fourth spacer 108. This prevents the horizontal plate 50 from being further depressed. The top hole 66, shown in FIG. 4, in the top 28 of the dispensing unit 10 is above the horizontal plate 50, preferably at the center of the horizontal plate 50. The top hasp 36 is welded to the top 28 of the dispensing unit 10. The flap 32 has the flap hole 34 which the top hasp 36 can go through. The flap 32 is coupled to the flap hinge 40. The side of the dispensing unit 10 also has the side hasp 38 welded to the dispensing unit 10. The side hasp 38 can also go through the flap hole 34 in the flap 32. The flap lock 42 can lock on either the side hasp 38 or the top hasp 36.

When the flap 32 is locked in the open position, thus allowing access to the top hole 66, the dispensing unit 10 can be used to dispense a liquid, such as soap. A user can push down on the horizontal plate 50 through the top hole 66. The horizontal plate 50 rests on top of the plunger 46, thus when the horizontal plate 50 is pushed down the plunger 46 is also pushed down. The spacers below the horizontal plate 50 will limit the distance the plunger 46 can be depressed. When the horizontal plate 50 no longer has pressure being put upon it the plunger 46 and horizontal plate 50 will move upward. The plunger includes, for example, a spring that causes the plunger to return to a upward position, thus, causing the plate to return to the upward position. The plunger includes, for example, a spring that causes the plunger to return to an upward position, thus, causing the plate to return to the upward position. Liquid travels through the output hose 14 and through the outlet 44 when the plunger 46 is being depressed. The plunger 46 and supply reservoir 12 are commonly known in the art. Advantageously, the height of the spacers determines how much liquid per depression will be dispensed from the dispensing unit 10. The shorter the height of the spacers the more the plunger 46 can be depressed causing more liquid to be dispensed through the outlet 44 each time the plate is depressed. Advantageously, if only a small amount of liquid is needed, tall spacers can be inserted to allow only a small movement of the plunger 46. Placing tall spacers beneath the horizontal plate 50, helps reduce the amount of waste, as only a small amount of liquid will be dispensed per depression. Preferably, the liquid being dispensed is hand soap, body soap, or dishwashing soap.

Advantageously, as shown in FIGS. 2 and 3, the outlet 44 is above the plunger 46 to minimize the amount of liquid that can drip from the outlet 44. When the plunger 46 is depressed liquid will be forced through the output hose 14 and out the outlet 44. However, when the plunger 46 is then released, excess liquid will naturally be drawn by gravity back to the plunger 46, instead of to the outlet 44. This keeps excess liquid from dripping onto, for example, the floor. Additionally, a short output hose 14 is used such that as little excess liquid remains in the output hose 14. Even if the outlet 44 is positioned below the plunger 46, the short output hose would allow only a minimal amount of liquid to drip out the outlet 44.

The horizontal plate 50 protects the supply reservoir 12, the plunger 46 and the output hose 14 from vandalism. The horizontal plate 50 allows the plunger 46 to be depressed without giving access to the supply reservoir 12. For example, an inmate in a correctional facility operating the dispensing unit 10 could not reach inside and get their fingers below the horizontal plate 50. If the horizontal plate 50 was not present the inmate would have direct access to the plunger 46 and the output hose 14 through the top hole 66. Furthermore, the horizontal plate 50, in conjunction with the spacers 58, 60, serves to limit the amount of liquid dispensed per depression, as described above.

The output hose 14 is coupled to the outlet 44 such that access to the output hose 14 is limited to when the lockable door 16 is unlocked and open. When the lockable door 16 is locked the output hose 14 is entirely enclosed in the dispensing unit 10. This prevents an inmate or other vandal from pulling on the output hose 14 and damaging the output hose 14, the supply reservoir 12, or the plunger 46. Advantageously, the outlet 44 can be a welded in metal feed-through to which the output hose 14 is coupled on the inside of the dispensing unit 10. The welded in metal feed-through is welded to the dispensing unit 10, beneath the overhang 20, this prevents the output hose 14 from being pulled upon from the outside of the dispensing unit 10.

The flap 32 on top 28 of the dispensing unit 10 can be locked in either the open or closed position. When the flap 32 is locked in the open position, it is locked to the side hasp 38 and the horizontal plate 50 can be depressed. When the flap 32 is locked in the closed position, it is locked to the top hasp 36 and covers the top hole 66 in the top 28 of the dispensing unit 10. Advantageously, this prevents the dispensing unit 10 from being used at improper times. This also limits the amount of liquid being dispensed and prevents needless waist of liquid, such as soap. When the flap 32 is locked in the open position, this prevents the flap 32 from being damaged or vandalized during normal operation. For example, in a correctional facility, an inmate using the dispensing unit 10 could not move the flap 32 around or attempt to remove the flap 32 as easily because it is locked to the side of the dispensing unit 10. The flap 32 is further shown in FIG. 8.

Advantageously, the lockable door 16 is recessed in the front of the dispensing unit 10 such that a hinge pin 78, shown in FIG. 7, cannot be slid out of the door hinge 26. FIG. 7 further shows this feature. The lockable door 16 can be opened to change or fill the supply reservoir 12 or any other damaged parts, although it is normally locked to prevent access to the inside of the dispensing unit 10.

The first door hasp 22 is welded to the lockable door 16. The second door hasp 24 is welded to the side of the dispensing unit 10, such that the hole in the first door hasp and the hole in the second door hasp line up when the lockable door 16 is closed. The door lock 52 can be put through the holes and closed to lock the door. The first door hasp 22 and the second door hasp 24 are advantageously welded to the dispensing unit 10. The first door hasp 22 and the second door hasp 24 could be screwed to the dispensing unit 10, however, this may allow for the possible removal of the screws if precautions, such as using security screws, were not taken.

Figure 4:
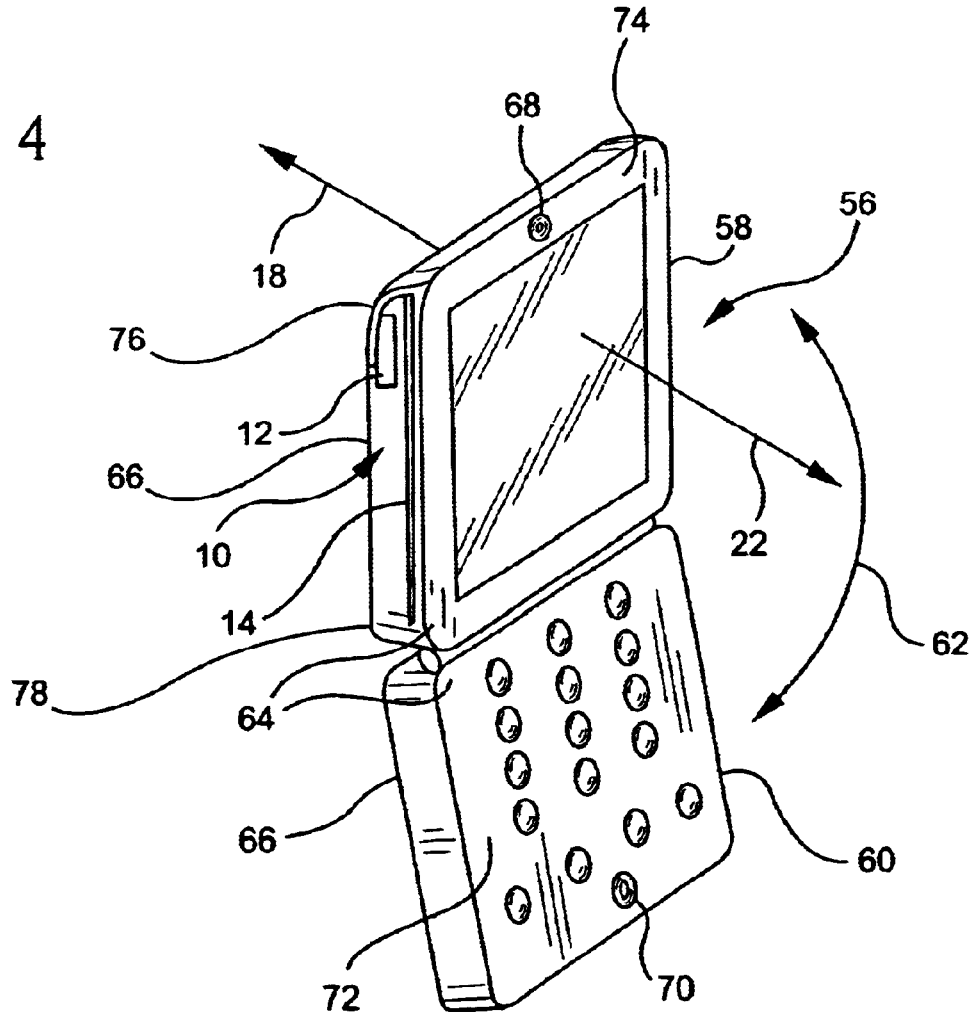
FIG. 4 is a top partial cross-sectional view of the dispensing unit of FIG. 1.

Referring to FIG. 4 shown is a partial top cross-sectional view of the dispensing unit 10 of FIG. 1. Shown is the top 28 of the dispensing unit 10, the top hole 66, the first security screw 54, the second security screw 56, the third security screw 68, the fourth security screw 70, the horizontal plate 50, the flap 32, the flap hinge 40, the flap hole 34, the first hinge screw 72, the second hinge screw 74, the third hinge screw 76, and the top hasp 36.

Shown is the top 28 of the dispensing unit 10 when the flap 32 is in the open position. This allows access to the top hole 66 so the dispensing unit 10 can be used. The first hinge screw 72, the second hinge screw 74, and the third hinge screw 76, secure the flap 32 to the top 28 of the dispensing unit 10. Advantageously, the first hinge screw 72, the second hinge screw 74, and the third hinge screw 76 are safety or prison screws. This is further described and shown in FIG. 8. Shown is the top hole 66 over the center of the horizontal plate 50.

Figure 5:
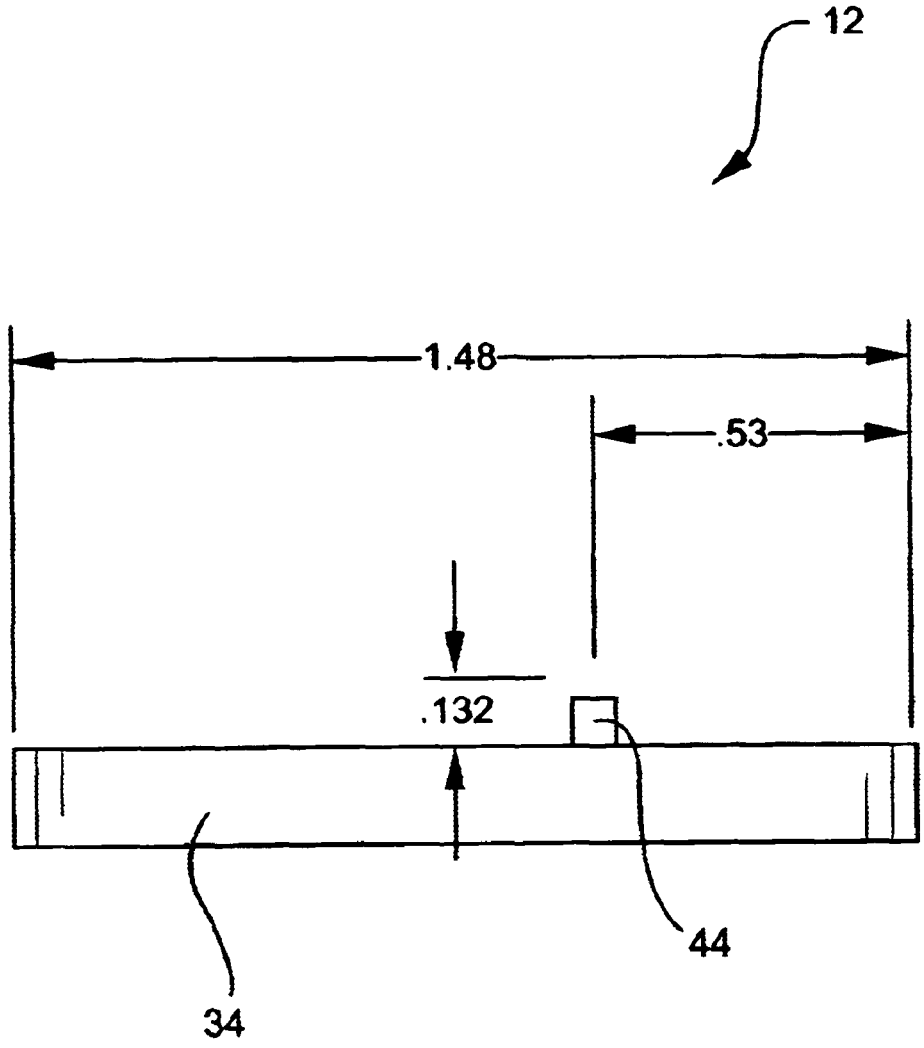
FIG. 5 is a top partial cross-sectional view of the dispensing unit of FIG. 1 with a closed flap.

Referring to FIG. 5 shown is a partial top cross-sectional view of the dispensing unit 10 of FIG. 1 with the flap 32 locked in the closed position. Shown is the top 28 of the dispensing unit 10, the flap 32, the flap hinge 40, the flap hole 34, the flap lock 42, the side hasp 38, and the top hasp 36.

Shown is the top 28 of the dispensing unit 10 when the flap 32 is locked, such that the dispensing unit 10 cannot be used. The flap 32 covers the top hole 66, such that the horizontal plate 50 is not exposed. Thus, the horizontal plate 50 cannot be depressed and liquid will not be dispensed from the dispensing unit 10. Advantageously the flap 32 is welded to or integral with the flap hinge 40 such that it is not necessary to have nuts exposed on the outside of the dispensing unit 10. This is further described and shown in FIG. 8.

Figure 6:
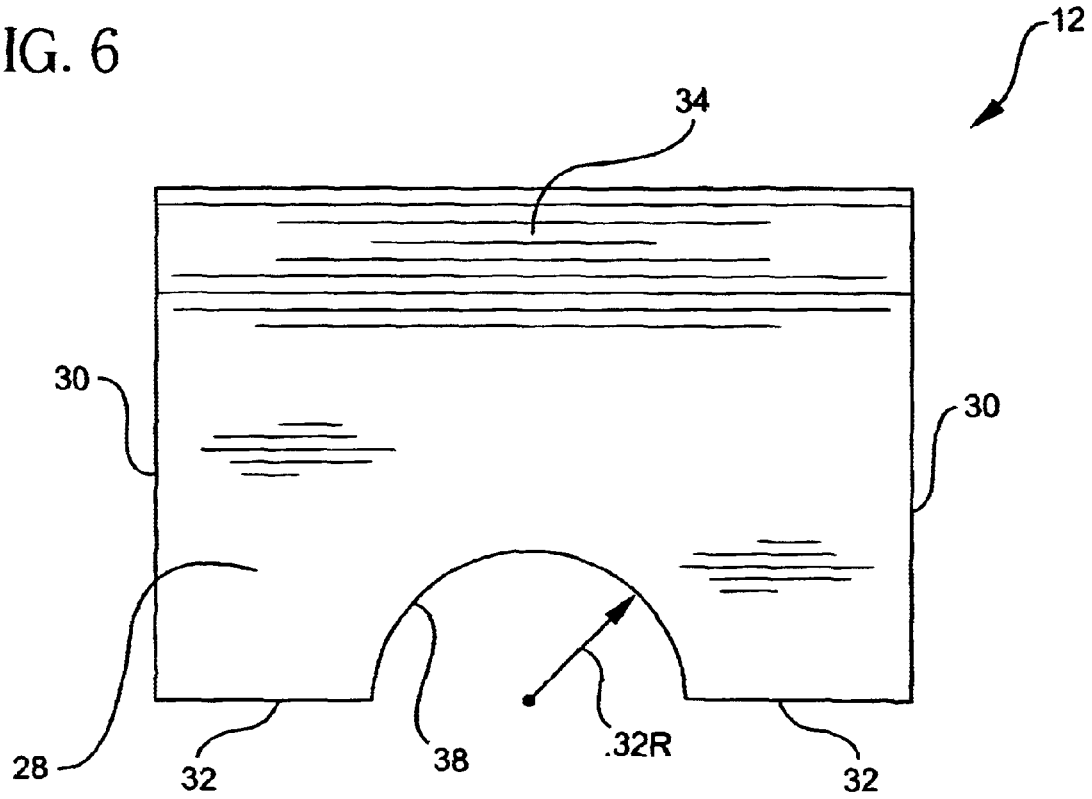
FIG. 6 is an enlarged view of the end of the upper hinge in FIG. 3 with crimps in the hinge.

Referring next to FIG. 6, shown is an end of the door hinge 26. Shown is the door hinge 26, the hinge pin 78, and crimps 80.

The crimps 80 in the door hinge 26 secure the hinge pin 78 to the door hinge 26. The door hinge 26 is crimped only on alternative sections so as to allow the lockable door 16 to open while not allowing the hinge pin 78 to slide out of the door hinge 26. Advantageously, this does not allow an inmate in a jail or prison to remove the hinge pin 78 and finish it into a weapon.

Referring to FIG. 7, a top view is shown of the door hinge 26. Shown is the door hinge 26, the lockable door 16, the door frame 18, the hinge pin 78, a first door hinge screw 81, a second door hinge screw 82, a first safety bar 84, a second safety bar 86, a first lock nut 88, and a second lock nut 90.

The door hinge 26 is recessed, so that the hinge pin 78 will not clear a frame of the lockable door 16, and thus cannot be removed from the door hinge 26, even if the crimps 80 in the door hinge 26 are loosened. The top 28, shown in FIG. 4, of the dispensing unit 10 will always be on top 28 of the hinge pin 78, whether the lockable door 16 is open or closed, thus preventing the hinge pin 78 from sliding out of the door hinge 26. The hinge pin 78 may also be optionally welded to the door hinge 26 at its ends, to further make difficult its removal.

The dashed line in FIG. 7, extending from the lockable door 16 to the door frame 18, represents the top 28 of the dispensing unit 10. The hinge pin 78 is underneath the top 28 of the dispensing unit 10, with very little space between the lockable door 16 and the top 28 of the dispensing unit 10 (better shown in FIG. 3). In order for the hinge pin 78 to slide out of the door hinge 26 the hinge pin 78 needs adequate space above the hinge pin 78. For example, the space between the hinge pin and the top of the dispensing unit 10 is small enough such that the hinge pin 78 could not be partially slid out of the door hinge 26 and then bent allowing for the hinge pin 78 to be further slid out of the door hinge 26, which eventually could lead to the hinge pin 78 being completely removed. Thus, because of the small space between the top 28 of the dispensing unit 10 and the hinge pin 78, if the hinge pin were attempted to be removed it would simply hit the top 28 of the dispensing unit 10 before it could be bent and its removal would be prevented. Even when the lockable door 16 is open, the hinge pin 78 has not moved out from underneath the top 28 of the dispensing unit, only the door has rotated, therefore, whether the lockable door 16 is open or closed, the hinge pin 78 will not be removable as it will still be underneath the top 28 of the dispensing unit 10. The bottom of the dispensing unit 10 functions in the same manner for a hinge pin 78 located at the bottom of the door hinge 26.

The door hinge 26 is secured to the lockable door 16 using the first door hinge screw 81, which is preferably a prison screw or other difficult to remove fastener. The first door hinge screw 81 passes through the door hinge 26, through the lockable door 16, and through the first safety bar 84 to the first lock nut 88, i.e., a hex nut including a nylon insert. Advantageously, the first safety bar 84 is aligned parallel to the door hinge 26 with the door frame 18 interposed between the safety bar 84 and the door hinge 26, and is threaded, such that even in the event the first lock nut 88 is removed, the first door hinge screw 81 is not readily removable from the door hinge 26. The first safety bar 84 and second safety bar 86 are strips of metal with threaded holes that are positioned along the safety bars so that they can be aligned with and juxtaposed against screw holes in the lockable door 16 and the door frame 18, respectively, and engaged by the first door hinge screw 81 and the second door hinge screw 82. The first door hinge screw 81 and the second door hinge screw 82 advantageously can be safety screws, e.g., prison screws. Both sides of the door hinge 26 are secured, respectively, to the door frame or the lockable door 16.

The second door hinge screw 82, which is also preferably a prison screw or other difficult to remove fastener passes through the door hinge 26, through the door frame and through the second safety bar 86. The second door hinge screw 82 is then inserted into the second lock nut 90 i.e., a hex nut including a nylon insert. The second safety bar 86 is also threaded, such that even in the event the second lock nut 90 is removed, the second door hinge screw 82 is not readily removable. When the first door hinge screw 81 and second door hinge screw 82 are prison screws a special tool is needed to remove them, which helps prevent an inmate from easily removing the screws. Advantageously, the screws are only accessible when the lockable door 16 is unlocked and open, further preventing their removal. This is important in a jail or correctional facility where a screw can be finished into a weapon.

Figure 8:
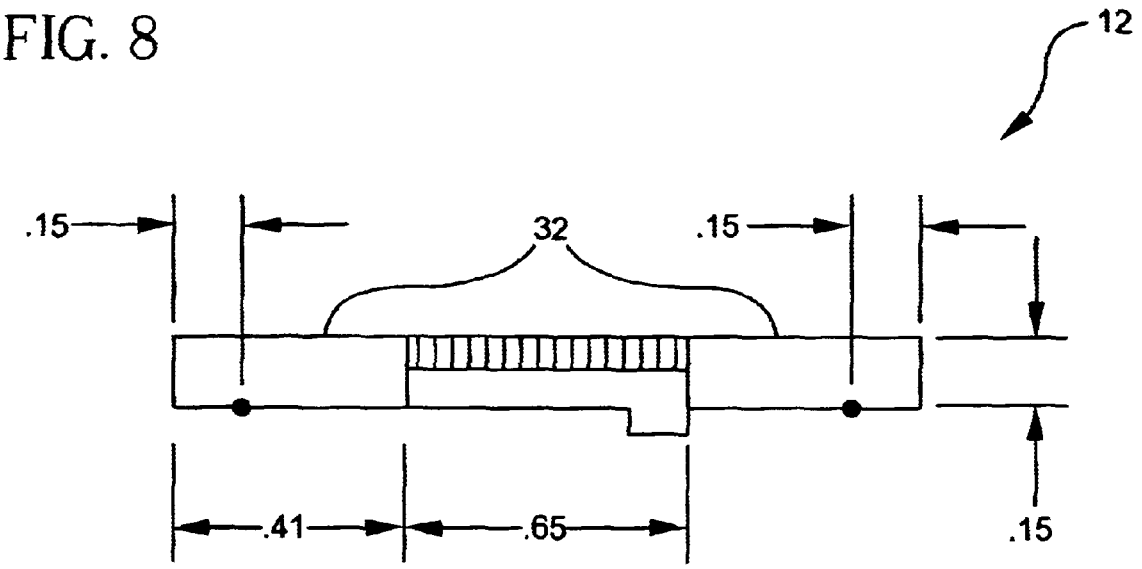
FIG. 8 is a an enlarged view of a flap hinge shown in FIG. 3.

Referring to FIG. 8 shown is an enlarged view of the flap hinge 40 shown in FIG. 3. Shown is the top 28, the flap hinge 40, the flap 32, a safety bar 92, a hinge nut 94, a flap hinge pin 96, and the first hinge screw 72.

Advantageously, the flap hinge 40 is crimped on alternate sections just as the door hinge 26 is crimped (see FIG. 6) such that the flap hinge pin 96 is not readily removable from the flap hinge 40. The flap hinge 40 is crimped only on alternative sections so the flap hinge 40 is still able to open or close. The flap hinge 40 can also be welded to the flap hinge pin 96 on either or both ends to further make difficult the removal of the flap hinge pin 96. The flap hinge pin 96 can be finished into a weapon if it is removed, thus it is desirable to make it as difficult as possible to remove.

Figure 9:
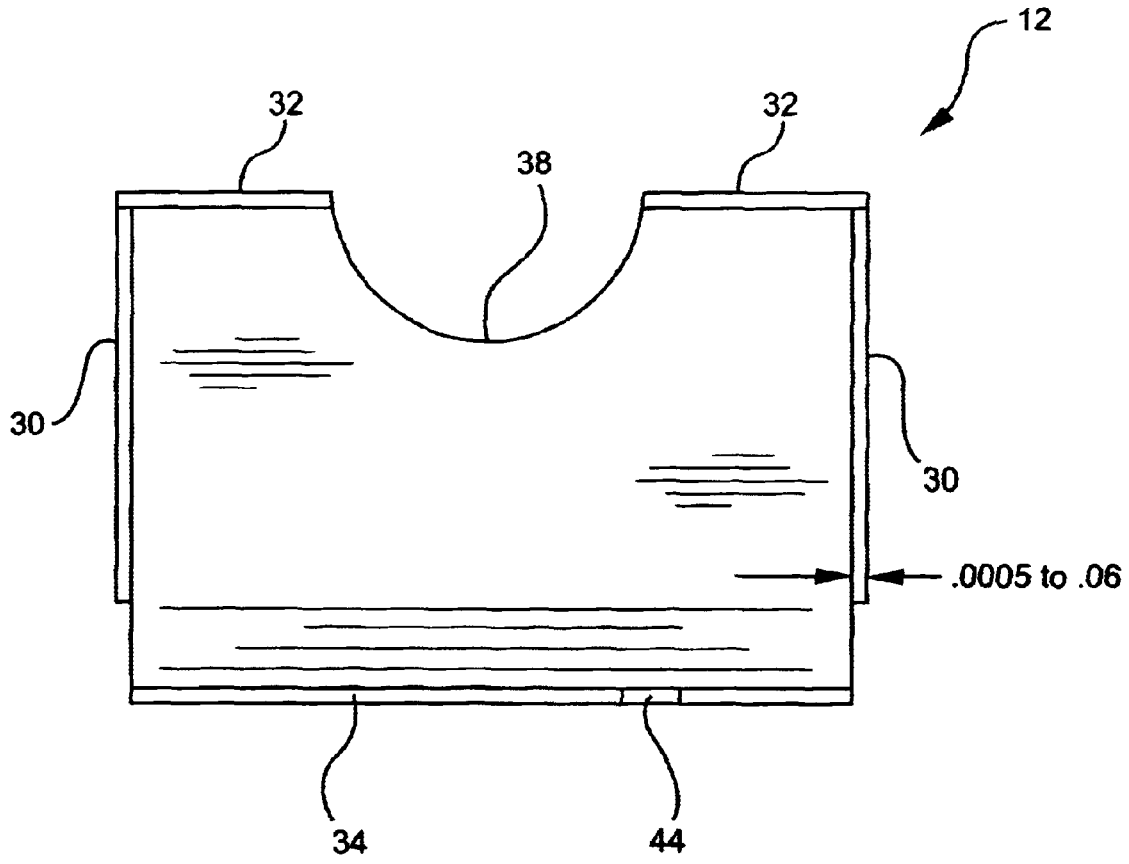
FIG. 9 is a perspective view of a second embodiment of the dispensing unit for use with a liquid, soap and other cleaning or chemical materials.

The flap 32 is welded to one side of the flap hinge 40. Advantageously, because the flap 32 is welded to the flap hinge 40 (or integral therewith, i.e., on extension of the flap hinge 40) instead of attached through the use of screws, there is a reduced risk of an inmate being able to remove a nut and screw from the dispensing unit 10 and using the screw as a weapon. Alternatively, however, the flap 32 may be attached with security screws, such as prison screws, having the flap 32 welded to the flap hinge 40 is also one way to allow the flap 32 to lay flush against the top 28 of the dispensing unit 10 when in the closed position. The other side of the flap hinge 40 is secured to the top 28 of the dispensing unit 32 through the use of the first hinge screw 72, the second hinge screw 74, and the third hinge screw 76, shown in FIG. 4, all of which may be security screws, such as prison screws. The first hinge screw 72 passes through the flap hinge 40, through the top 28 of the dispensing unit 10, through the safety bar 92, and is coupled to the hinge nut 94. Advantageously, the safety bar 92 is threaded such that if the hinge nut 94 is removed the first hinge screw 72, the second hinge screw 74, and the third hinge screw 76 are not readily removable. The safety bar 92 is a strip of metal with threaded holes that are positioned along the safety bar so that they can be aligned with and juxtaposed against screw holes in the top 28 of the dispensing unit 10, and engaged by first hinge screw 72, the second hinge screw 74, and the third hinge screw 76. The first hinge screw 72, the second hinge screw 74, and the third hinge screw 76 advantageously can be safety screws, e.g., prison screws Referring to FIG. 9 shown is a perspective view of a dispensing unit 100 for use with a liquid, such as soap and other cleaning or chemical materials. Shown is the dispensing unit 100, the supply reservoir 12, the supply reservoir cap 48, the plunger 46, the output hose 14, an indentation 102 in the lockable door 16, the door hasp 25, the top 28, the top hole 66, the horizontal plate 50, the first security screw 54, the second security screw 56, the third security screw 68, the fourth security screw 70, the first spacer 58, the second spacer 60, the first nut 62, the second nut 64, and the door hinge 26.

The embodiment shown in FIG. 9 is identical in all respects to the embodiment of FIG. 1, except that the flap 32 is not shown in FIG. 9 (although the flap is preferably present in the embodiment of FIG. 9) and the lockable door 16 and outlet 44 are slightly varied. Additionally, the embodiment of FIG. 9 does not have the overhang 20 as the outlet has been moved to the indentation 102 in the lockable door 16. The indentation 102 in the lockable door 16 will be described in detail with reference to FIG. 11. The output hose 14 is shown decoupled from an outlet 104, shown in FIG. 11, for illustration purposes.

The flap 32, described with reference to FIGS. 4, 5 and 8, is not shown in the embodiment of FIG. 9, however, it is preferably added to this embodiment. The embodiment shown in FIG. 9 has all the tamper-proof features as the embodiment shown in FIG. 1, and such as are discussed with reference to FIGS. 1–8.

The supply reservoir 12 is housed within the dispensing unit 100 and is only accessible through the lockable door 16 at the front of the dispensing unit 100. The supply reservoir 12 is only accessible when the lockable door 16 is open. The supply reservoir cap 48 is coupled to the top of the supply reservoir 12, e.g. the supply reservoir cap 48 is screwed onto the supply reservoir 12. The plunger 46, such as is known in the art, and such as is described above, goes through the supply reservoir cap 48 and is coupled to the output hose 14. The plunger 46 includes, for example, a spring that allows the plunger to be depressed (in order to pump liquid) and then return, under spring force, to the upward position.

The lockable door 16 is coupled to the door frame by the door hinge 26. The lockable door 16 has the indentation 102 formed in the front side. The lockable door 16 also preferably has a hole in the front which is aligned with the door hasp 25, and through which the door hasp passes when the lockable door is closed, such that the lockable door 16 can be locked by placing a padlock through the door hasp 25 when the lockable door 16 is closed. The door hasp 25 is welded to an inside of the dispensing unit 100.

The top 28 of the dispensing unit 100 includes the top hole 66. Below the top 28, inside the dispensing unit 100 is the horizontal plate 50. The first security screw 54, the second security screw 56, the third security screw 68, and the fourth security screw 70 go through the top 28 of the dispensing unit 100 and through the horizontal plate 50. The horizontal plate 50 is above the first spacer 58, the second spacer 60, the third spacer, and the fourth spacer 108 through which the first security screw 54, the second security screw 56, the third security screw 68, and the fourth security screw 70 pass, respectively. The first security screw 54, the second security screw 56, the third security screw 68, and the fourth security screw 70 are then coupled to the first nut 62, the second nut 64, a third nut and a fourth nut, respectively. Advantageously, the screws could be prison screws and the nuts could be hex nuts with nylon inserts.

Figure 10:
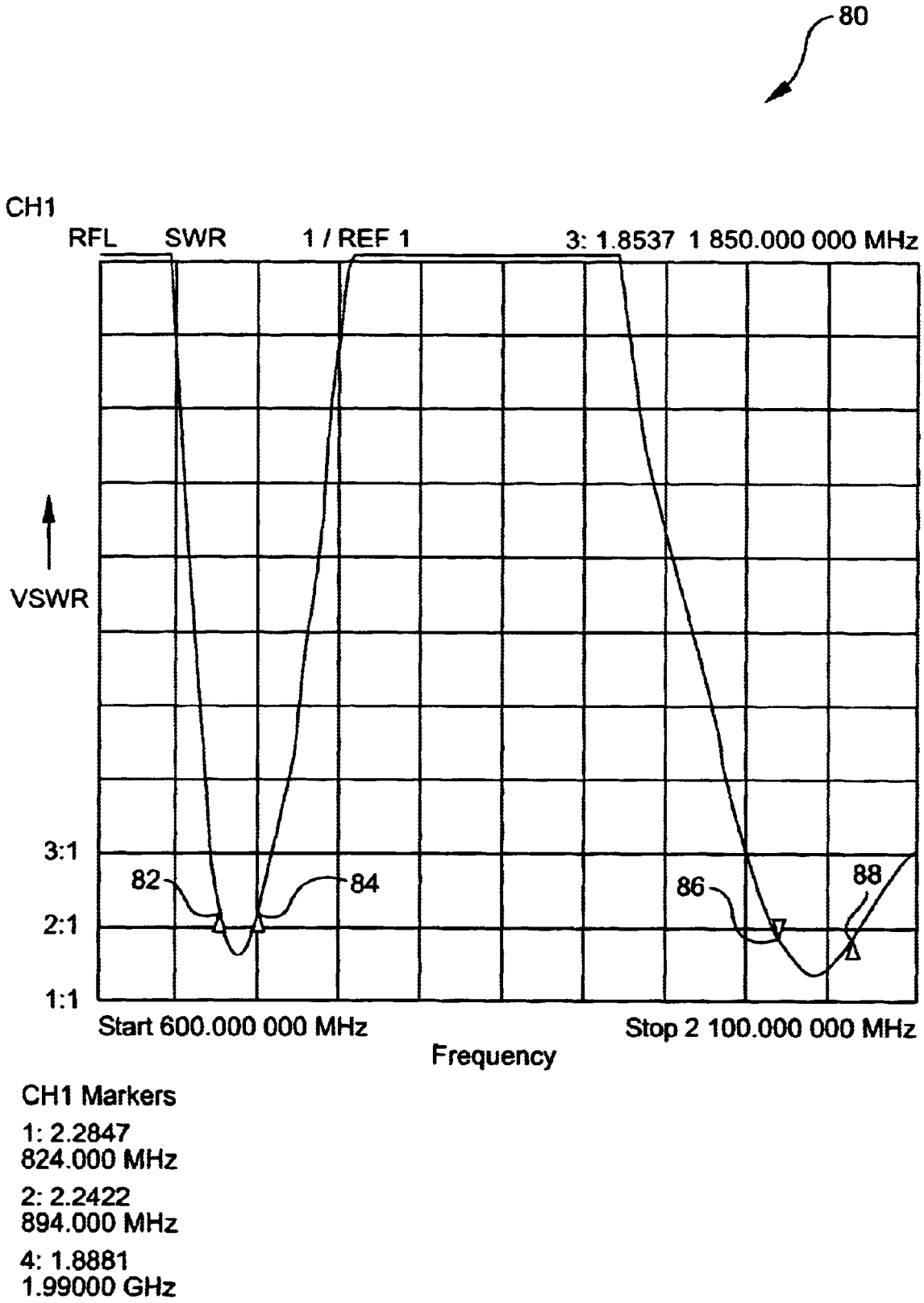
FIG. 10 is a front partial cross-sectional view of the dispensing unit of FIG. 9.

Referring next to FIG. 10, shown is a front partial cross-sectional view of the dispensing unit 100 of FIG. 9. Shown is the dispensing unit 100, the supply reservoir 12, the supply reservoir cap 48, the plunger 46, the output hose 14, the indentation 102 in the lockable door 16, the door hasp 25, the door lock 52, the top 28, the horizontal plate 50, the first security screw 54, the second security screw 56, the first spacer 58, the second spacer 60, the first nut 62, the second nut 64, and the door hinge 26.

Shown is the horizontal plate 50 coupled to the first security screw 54 and the second security screw 56. The horizontal plate 50 is lying on the top of the plunger 46 such that when the horizontal plate 50 is depressed the plunger 46 is also depressed, thus causing fluid from the supply reservoir 12 to travel through the output hose 14 and out the outlet 104, shown in FIG. 11. The first spacer 58 and the second spacer 60 are inserted above the first nut 62 and the second nut 64 but below the horizontal plate 50. This allows the user to change the height of the spacers to adjust the amount of fluid that will be dispensed each time the horizontal plate 50 is depressed. The horizontal plate 50 also limits access to the inside of the dispensing unit 100, thus protecting the supply reservoir 12, the plunger 46 and the output hose 14 from vandalism.

Figure 11:
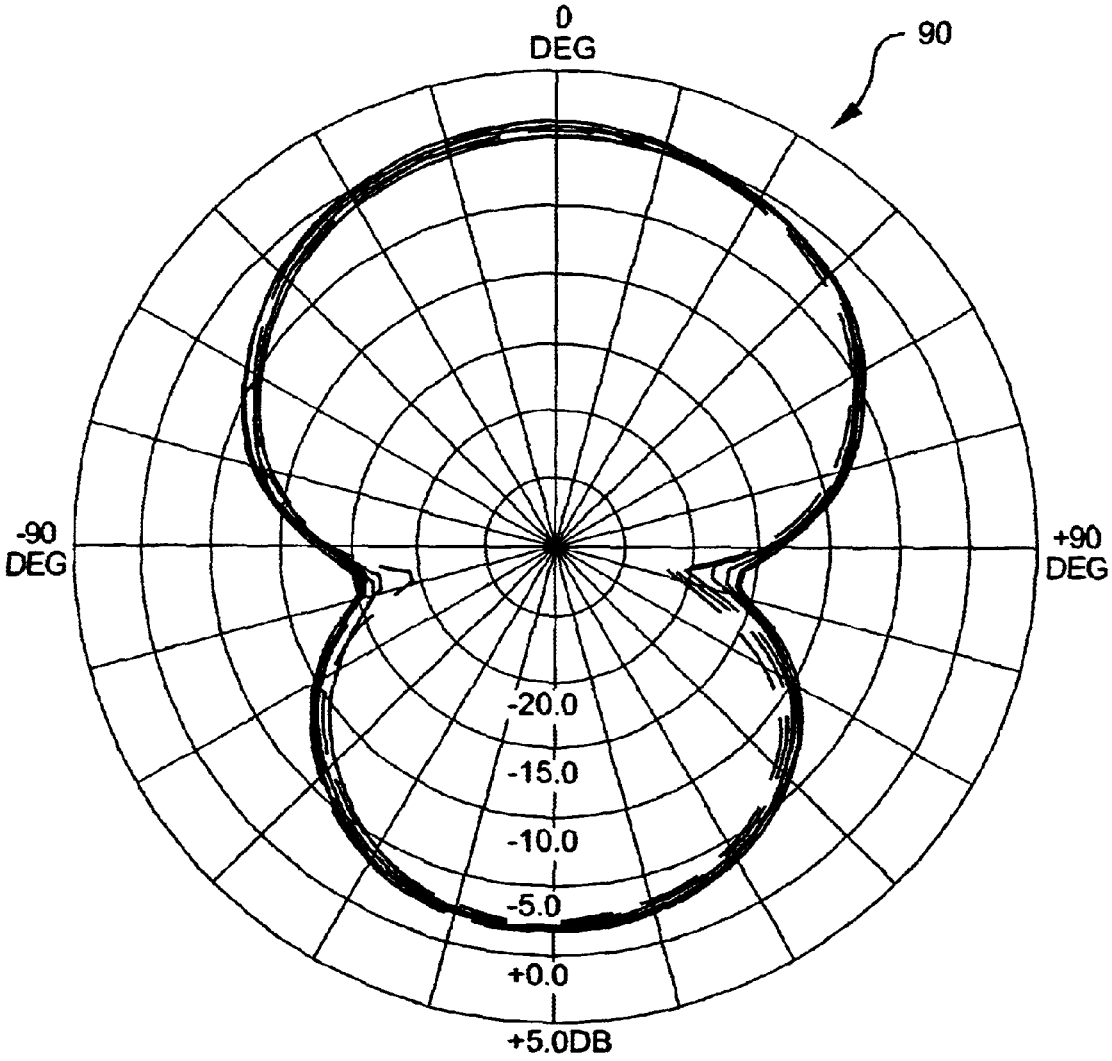
FIG. 11 is a side partial cross-sectional view of the dispensing unit of FIG. 9.

Referring next to FIG. 11, shown is a side partial cross sectional view of the dispensing unit 100 of FIG. 9. Shown is the dispensing unit 100, the supply reservoir 12, the supply reservoir cap 48, the plunger 46, the output hose 14, the outlet 104, the indentation 102 in the lockable door 16, the door hasp 25, the door lock 52, the top 28, the horizontal plate 50, the second security screw 56, the fourth security screw 70, the second spacer 60, the fourth spacer 108, the second nut 64, and a fourth nut 110.

Shown is the outlet 104 in the indentation 102 of the lockable door 16. Also shown is the door lock 52 in the indentation 102 of the lockable door 16. Advantageously, the door lock 52 is recessed to make it more tamper resistant. When the door lock 52 is recessed it is less susceptible to being broken. For example, an inmate in a prison trying to break the door lock 52 by striking it would be less likely to actually break the door lock 52 when it is in the recessed position as compared to the door lock 52 being positions against a flat door.

The output hose 14 is coupled to both the plunger 46 and the outlet 104. The outlet 104 is preferably a metal feed-through welded to the lockable door 16. Advantageously the outlet 104 is not aligned vertically, but is angled slightly back toward the inside of the dispensing unit 100 to prevent the filling of large containers that do not fit within the indentation 102, such as large buckets or garbage cans. The output hose 14 must be long enough such that when the lockable door 16 is opened the output hose 14 does not pull upon the supply reservoir 12 and tip it over. Advantageously, this also prevents excess dripping from the dispensing unit 100 as any excess fluid from the supply reservoir 12 will be caught in the output hose 14 and not drip from the outlet 104.

Figure 12:
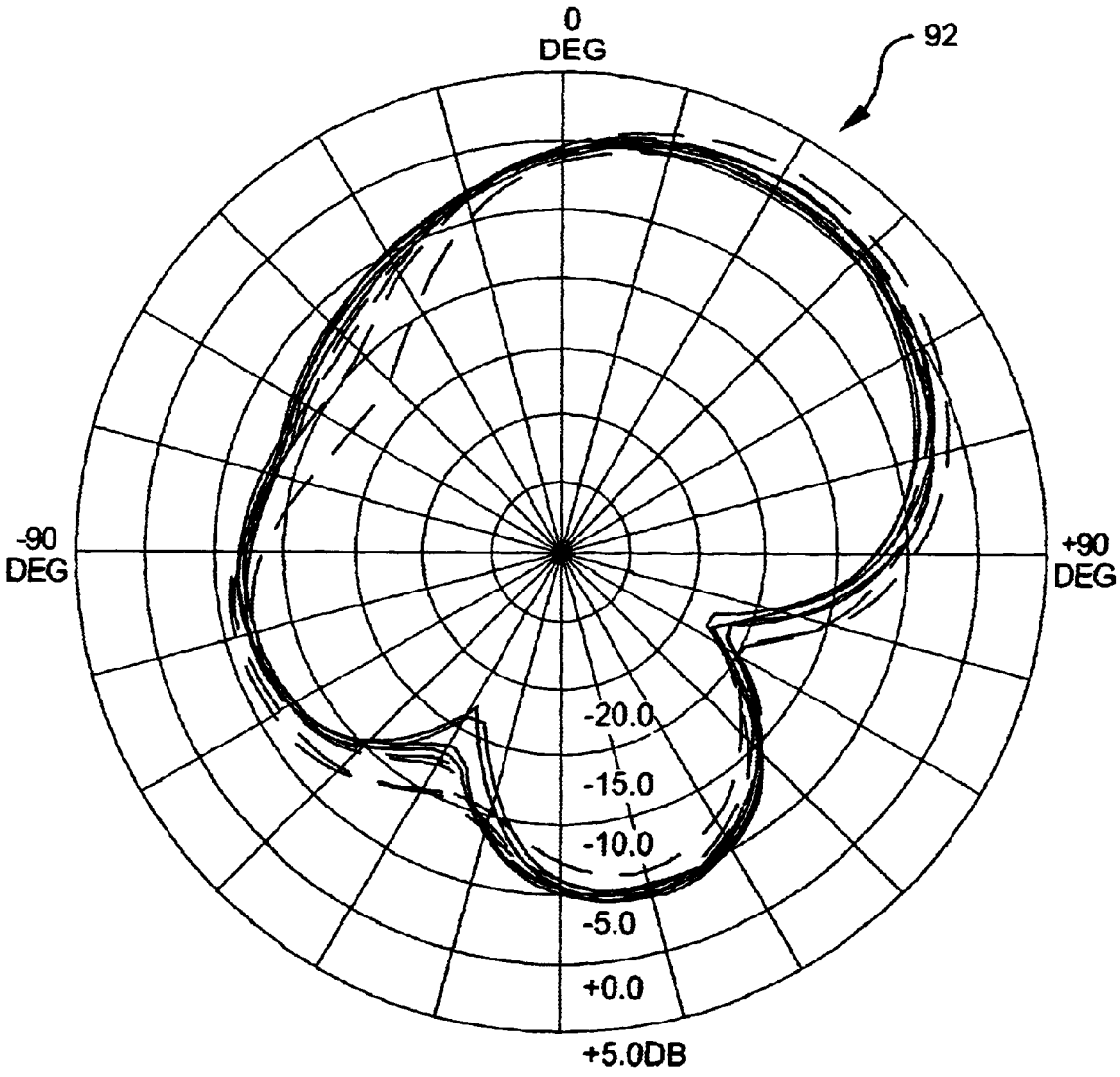
FIG. 12 is a perspective view of a dual outlet dispensing unit for use with a liquid, soap and other cleaning or chemical materials.

Referring to FIG. 12, shown is a perspective view of a dual outlet dispensing unit 120 for use with a liquid, soap and other cleaning or chemical materials. Shown is the dual outlet dispensing unit 120, a first top hole 122, a second top hole 124, a first outlet 126, a second outlet 128, a first output hose 130, a second output hose 132, a first outlet shield 134, a second outlet shield 136, the lockable door 16, the first door hasp 22, the second door hasp 24, the top hasp 36, the side hasp 38, the door lock 52, the flap 140, the flap lock 42, the flap hinge 40, the flap hole 34, and an inside panel 138.

The dual outlet dispensing unit 120 has all of the tamper-proof features of the dispensing unit 10 of FIG. 1. These features are describe with reference to FIGS. 1 through 8. The dual outlet dispensing unit 120 is larger than the dispensing unit 10 of FIG. 1, as it provides for a first outlet 126, a second outlet 128, and two supply reservoirs 12. Therefore, many of the structural aspects of the dispensing unit 10 of FIG. 1 are present two times in the dual outlet dispensing unit 120, such as the horizontal plate 50, the plunger 46, the supply reservoir cap 48, the supply reservoir 12, the top hole 66, etc.

As shown there is the first top hole 122 and the second top hole 124 for controlling the output of fluid from the first outlet 126 and the second outlet 128, respectively. The first outlet shield 134 and the second outlet shield 136 are welded on three sides and left open at the bottom, thus protecting the first outlet 126 and second outlet 128, respectively, while allowing fluid to be dispensed. The first outlet shield 134 and the second outlet shield 136 protect the first outlet 126 and the second outlet 128 from any impact, such as an inmate kicking the dual outlet dispensing unit 120. Advantageously, the first outlet shield 134 extends farther down past the end of the first outlet 126, such that if an inmate placed a finger on the first outlet 126 trying to direct fluid outward from the dual output dispensing unit 120 the fluid would hit the first outlet shield 134 and not project across the room. The second outlet shield 136 acts in the same fashion. The first outlet shield 134 could also be used on the dispensing unit 10 of FIG. 1 in place of the overhang 20. Additionally, the overhang 20 shown in FIG. 1 could be used on the dual outlet dispensing unit 120 in place of the outlet shields 134 and 136.

Advantageously, the first outlet shield 134 is made from sheet metal. The first outlet 126 is a piece of metal tubing welded to the lockable door 16. The first outlet shield 134 is a convex portion of the lockable door 16. The first outlet shield 134 protrudes from the lockable door 16 above the first outlet 126 and on both sides of the first outlet 126. This forms a protective shielding around three sides of the first outlet 126. However, the first outlet shield 134 does extend down past the bottom of the first outlet 126 such that the bottom of the first outlet shield 134 is below the piece of metal tubing making up the first outlet 126. The first outlet shield 134 is shown extending below the first outlet 126 in FIG. 13. The bottom of the first outlet shield 134 is left open, such that the liquid can flow from the first outlet 126 and into, for example, a bucket. The second outlet shield 136 functions and is structurally the same as the first outlet shield 134.

In one embodiment the first outlet shield 134 is a piece of sheet metal that has been welded to the lockable door 16. The first outlet shield 134 is welded to a portion of the lockable door 16 above and to both sides of the first outlet 126. The piece of sheet metal creates a convex section in the lockable door 16. The bottom of the first outlet shield 134 is left detached from the lockable door 16, such that the liquid can be dispensed from the first outlet 126 into, for example, a hand held container.

In another embodiment the first outlet shield 134 is in the shape of a section of a hollow cone cut along its vertical axis, as is shown in FIG. 12, however, many different shapes could be used. The inverted section of the cone is welded along both sides down to the vertex. The sides extend below the first outlet 126, such that the circular portion of the section of the cone is below the first outlet 126. This forms a protective shield from the top and both sides of the first outlet 126. This protects the first outlet 126 from vandalism, such as attempting to hit or kick the first outlet 126.

The inside panel 138 is welded to the inside of the dual outlet dispensing unit 120, and separates the two supply reservoirs inside. This prevents the supply reservoirs from being able to tip over. Additionally, the inside panel 138 prevents a larger supply reservoir from being put inside the dual outlet dispensing unit 120. Although shown with the inside panel 138, this is an optional feature of the dual outlet dispensing unit 120 and may be omitted, if desired.

The dual outlet dispensing unit 120 also has the flap 140 that locks either in an open or closed position. The flap 140 will be larger than the flap 32 shown in FIG. 1 so that it covers both the first top hole 122 and second top hole 124, however it functions exactly the same as the flap 32 described with reference to FIGS. 4, 5, and 8.

Figure 13:
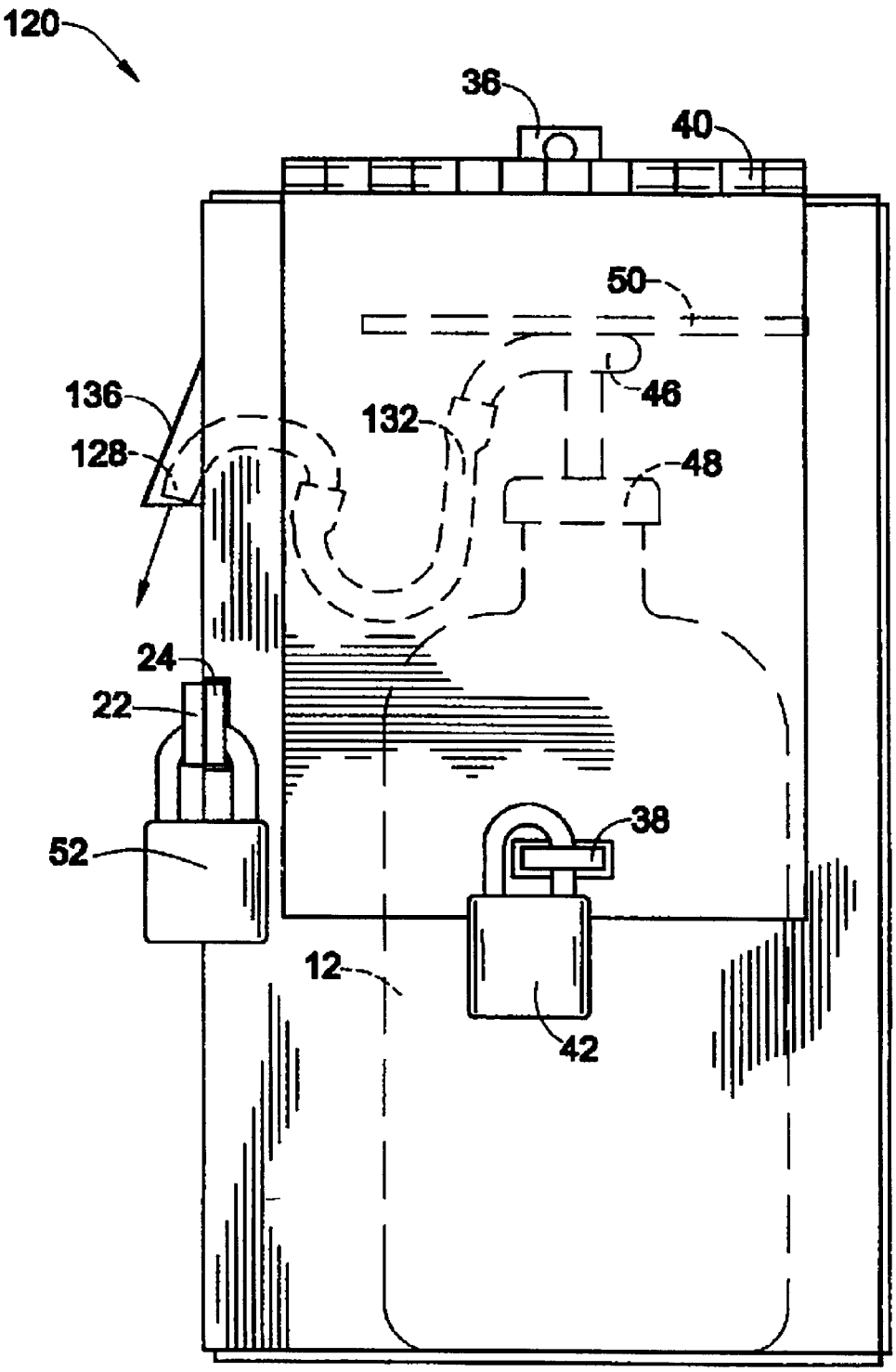
FIG. 13 is a side partial cross sectional view of the dual outlet dispensing unit of FIG. 12.

Referring to FIG. 13, shown is a side partial cross sectional view of the dual outlet dispensing unit 120 of FIG. 12. Shown is the dual outlet dispensing unit 120, the supply reservoir 12, the supply reservoir cap 48, the plunger 46, the second output hose 132, the second outlet 128, the second outlet shield 136, the horizontal plate 50, the flap 140, the flap hinge 40, the top hasp 36, the side hasp 38, the flap lock 42, the first door hasp 22, the second door hasp 24, and the door lock 52.

Shown is the second outlet shield 136 in the shape of a nose guard. Advantageously, this allows the second outlet shield 136 to be one continuous sheet of metal welded to the lockable door 16. However, the second outlet shield 136 could be any shape that protects the second outlet 128 from damage. For example, the second outlet 128 is protected from an inmate kicking or hitting the second outlet 128 by the second outlet shield 136.

Figure 14:
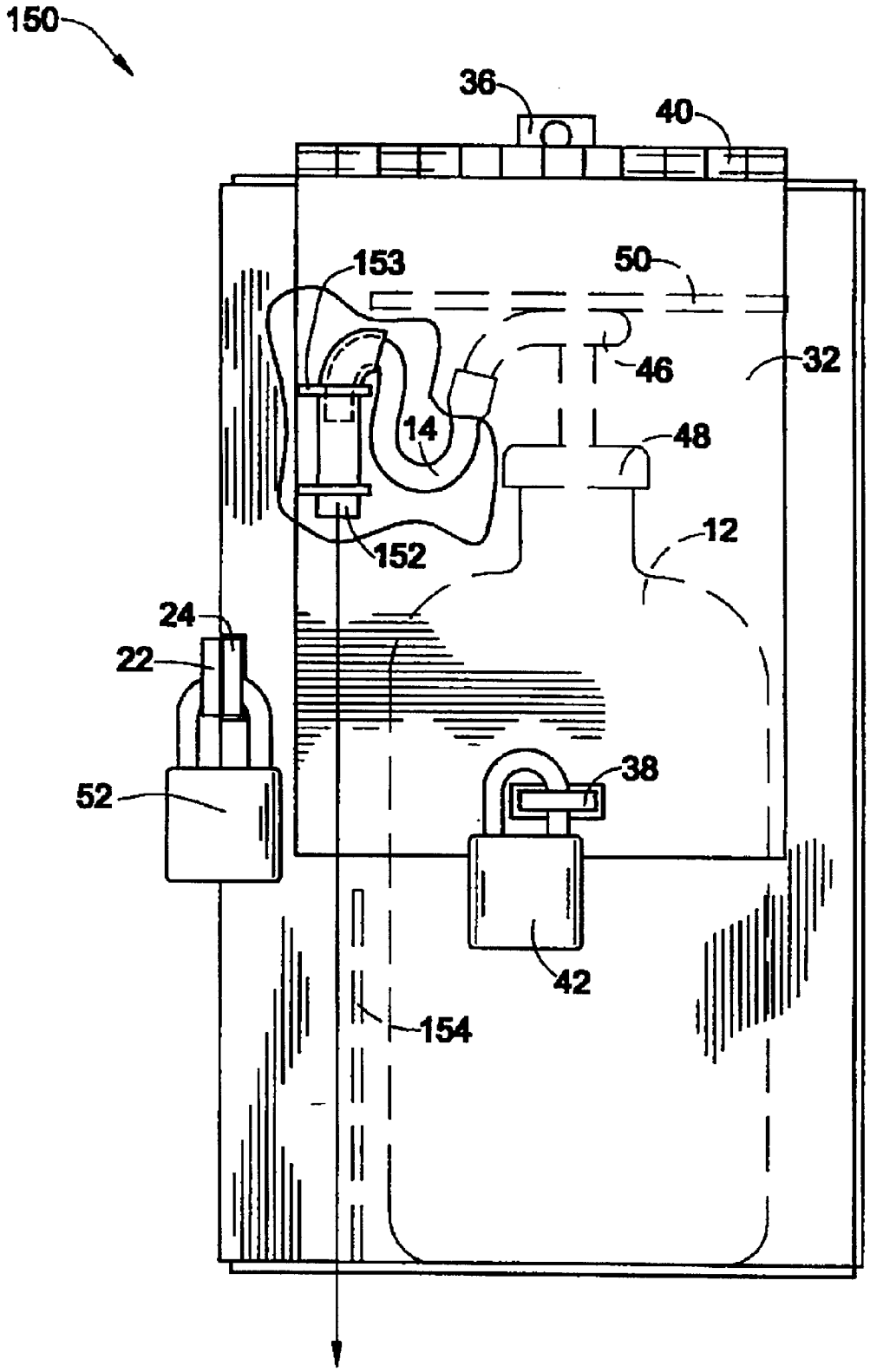
FIG. 14 is a side partial cross sectional view of a base outlet dispensing unit for use with a liquid, soap and other cleaning or chemical materials.

Referring to FIG. 14, shown is a side partial cross sectional view of a base outlet dispensing unit 150. Shown is the base outlet dispensing unit 150, the supply reservoir 12, the supply reservoir cap 48, the plunger 46, the output hose 14, the outlet 152, a retaining band 153, an inner shield 154, the flap lock 42, the door lock 52, the first door hasp 22, the second door hasp 24, the horizontal plate 50, the top hasp 36, the side hasp 38, the flap 32, and the flap hinge 40.

The lockable door 16, the flap 32, the horizontal plate 50, the plunger 46, the supply reservoir cap 48, and the supply reservoir 12, are functionally and structurally the same as the embodiment of FIG. 1. The details of these aspects of the embodiment of FIG. 14 are described in detail with reference to FIGS. 1–8.

Figure 15:
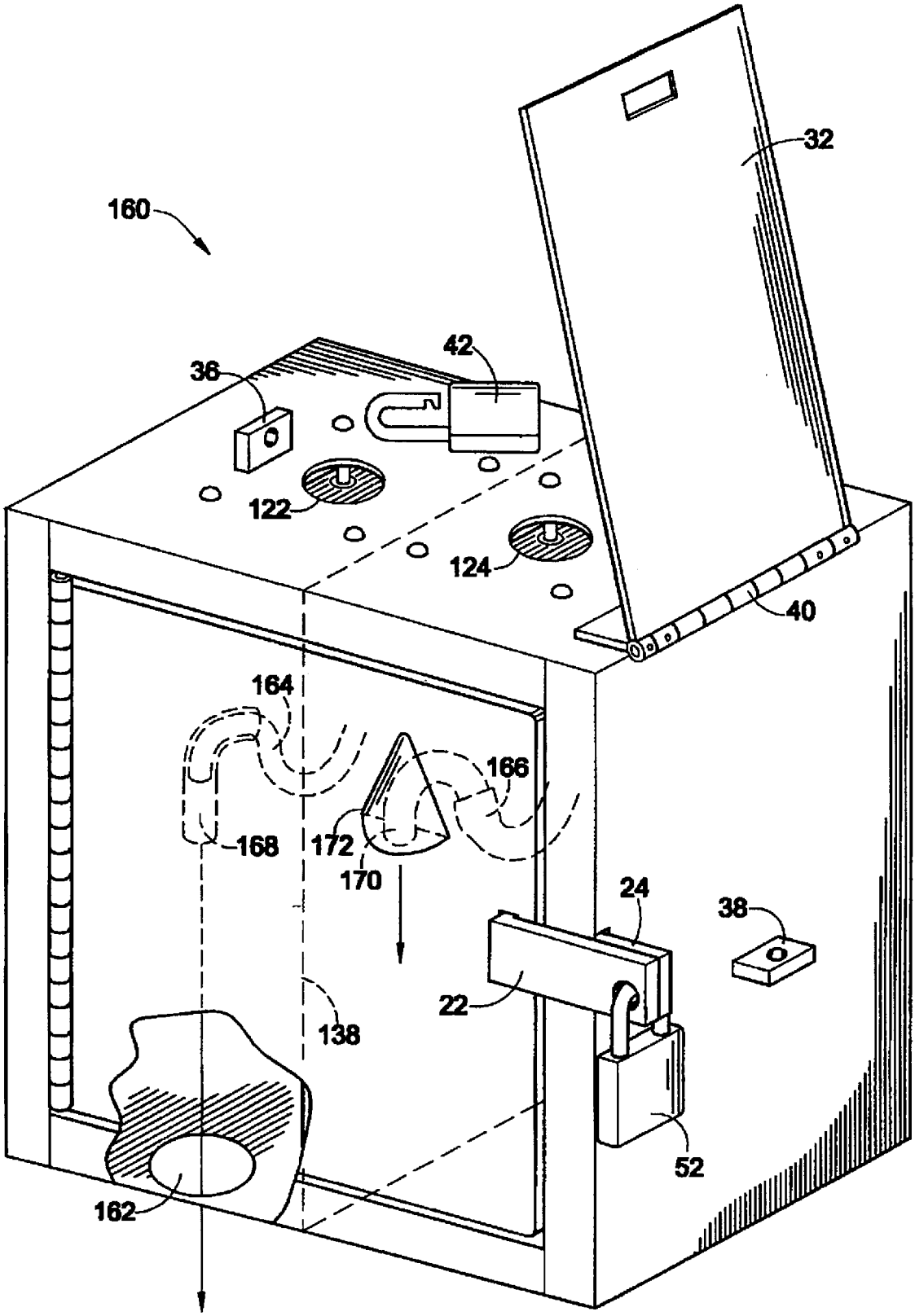
FIG. 15 is a perspective view of a combination outlet dispensing unit for use with a liquid, soap and other cleaning or chemical materials.

A base hole 162, similar to the one shown in FIG. 15, in the base outlet dispensing unit 150 is where fluid will be dispensed. Shown is the inner shield 154, welded to the inside of the base outlet dispensing unit 150 between the supply reservoir 12 and the base hole 162. The inner shield 154 is preferable an "L"-shaped metal piece and is juxtaposed with a corner of the base outlet dispensing unit 150 to form a hollow vertical passage at a base of which is positioned the base hole 162, which may be round. The outlet 152 is a metal tube that is coupled to the side of the base outlet dispensing unit 150 by the retaining band 153 that holds it in place. The output hose 14 is coupled to the outlet 152 and the plunger 46. The outlet 152 is aligned directly above the base hole 162, such that fluid will leave the outlet 152 and fall, by gravity, through the passage formed by the inner shield 154, and then through the base hole 162.

When the horizontal plate 50 is depressed fluid travels through the output hose 14 and out the outlet 152. The fluid then falls through the base hole 162 and preferably into a mop bucket or other container. The base outlet dispensing unit 150 could also be placed above a sink, such that dishwashing liquid would fall directly into the sink. The outlet 152 is positioned above the supply reservoir 12 such that excess fluid will not drip from the outlet 152. The air gap between the outlet 152 and the base hole 162 also prevents dripping. If the output hose 14 were to extend the entire length to the base hole 162 excess fluid would drip from the outlet 152 after the desired amount of fluid has already been dispensed.

The inner shield 154 forms a protective barrier between the base hole 162 and the supply reservoir 12. The inner shield 154 should be as tall as necessary depending on the application. For example, in a jail or correctional facility, the inner shield 154 should be tall enough such that if an inmate could stick a finger up through the base hole 162, he or she could not access the supply reservoir 12. This prevents an inmate who sticks his finger up through the base hole 162 from being able to touch the supply reservoir 12 or output hose 14, thus preventing harm to the supply reservoir 12 and the output hose 14.

Referring to FIG. 15, shown is a perspective view of a combination outlet dispensing unit 160 for use with a liquid, soap and other cleaning or chemical materials. Shown is the combination outlet dispensing unit 160, the first top hole 122, the second top hole 124, the base hole 162, an outlet shield 172, a first outlet 168, a first outlet hose 164, a second outlet 170, a second outlet hose 166, the flap 140, the flap hinge 40, the flap lock 42, the top hasp 36, the side hasp 38, the door lock 52, the first door hasp 22, the second door hasp 24, the lockable door 16, and the inside panel 138.

Shown is the combination outlet dispensing unit 160 similar to the dual outlet dispensing unit 120 of FIG. 12.

However, one side of the dual outlet dispensing unit 120 has been replaced by the base outlet dispensing unit 150 of FIG. 14. The combination outlet dispensing unit 160 has all the features described with reference to FIGS. 1 through 14. The first outlet 168 is the same as the outlet described in FIG. 14, while the second outlet 170 and the outlet shield 172 are described in detail with reference to FIGS. 12 and 13. The flap 140 is also described with reference to FIG. 12.

When the horizontal plate 50 below the first top hole 122 is depressed fluid will flow from the first outlet 168 and out through the base hole 162. If the horizontal plate below the second top hole 124 is depressed fluid will flow from the second outlet 170.

Advantageously, the combination outlet dispensing unit 160 could be used to fill both hand held containers and buckets. The base hole 162 could be used to fill buckets or dispense directly into a sink, while the second outlet 170 with the outlet shield 172 could be used for hand soap or to fill hand held containers such as spray bottles with fluid.

Figure 16:
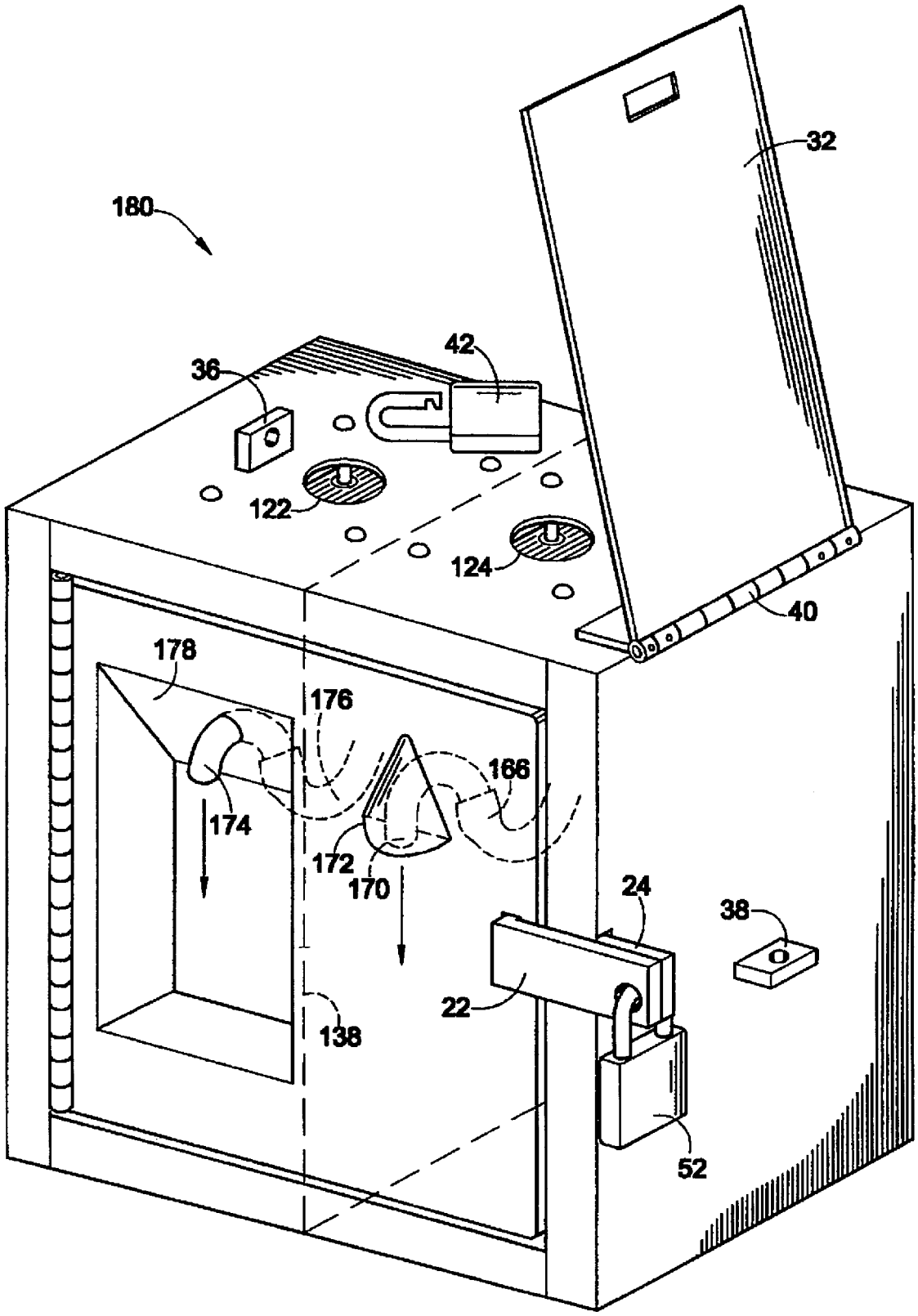
FIG. 16 is a perspective view of a combinational outlet dispensing unit for use with a liquid, soap, and other cleaning or chemical materials.
Figure 1:
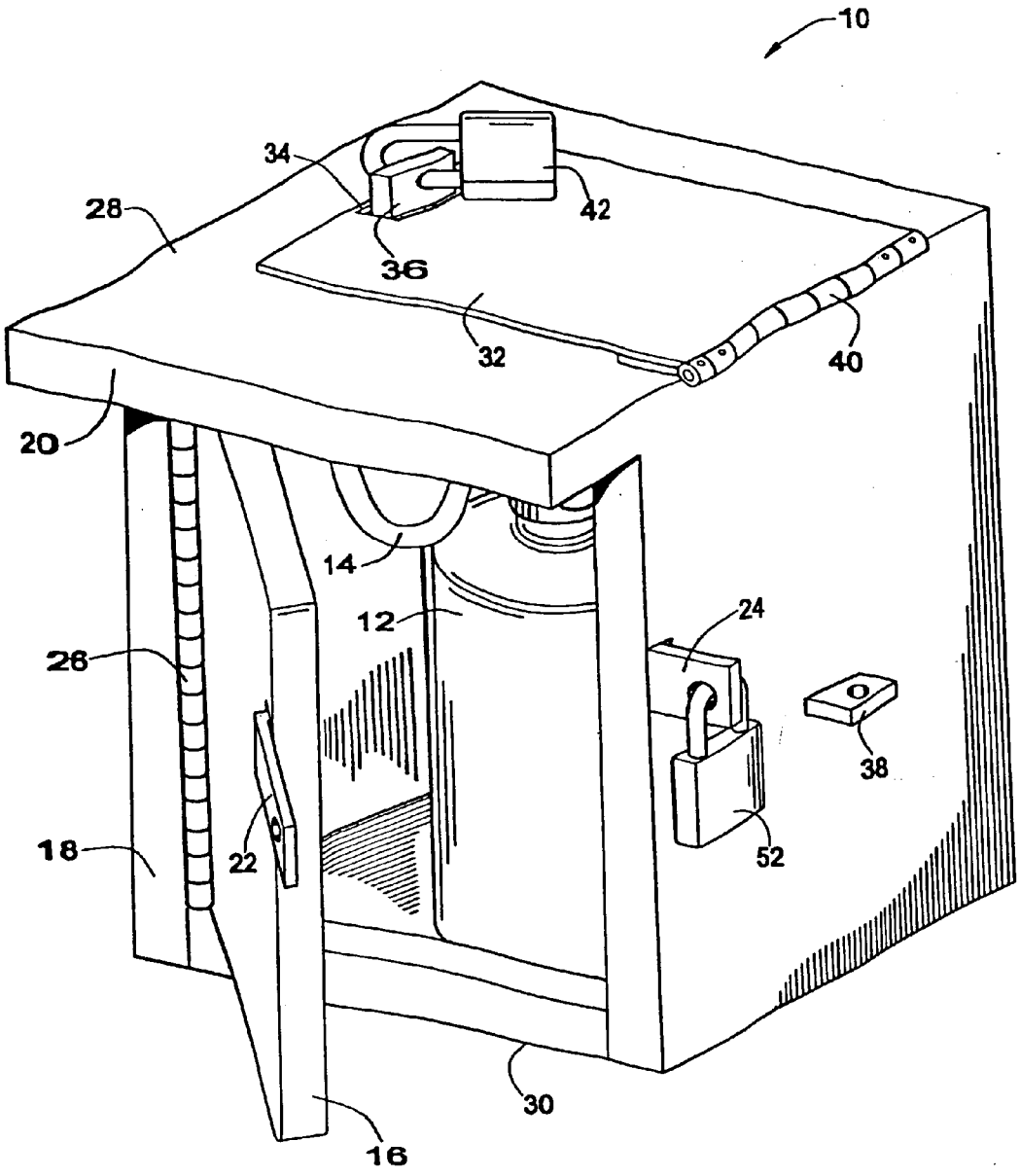
Figure 2:
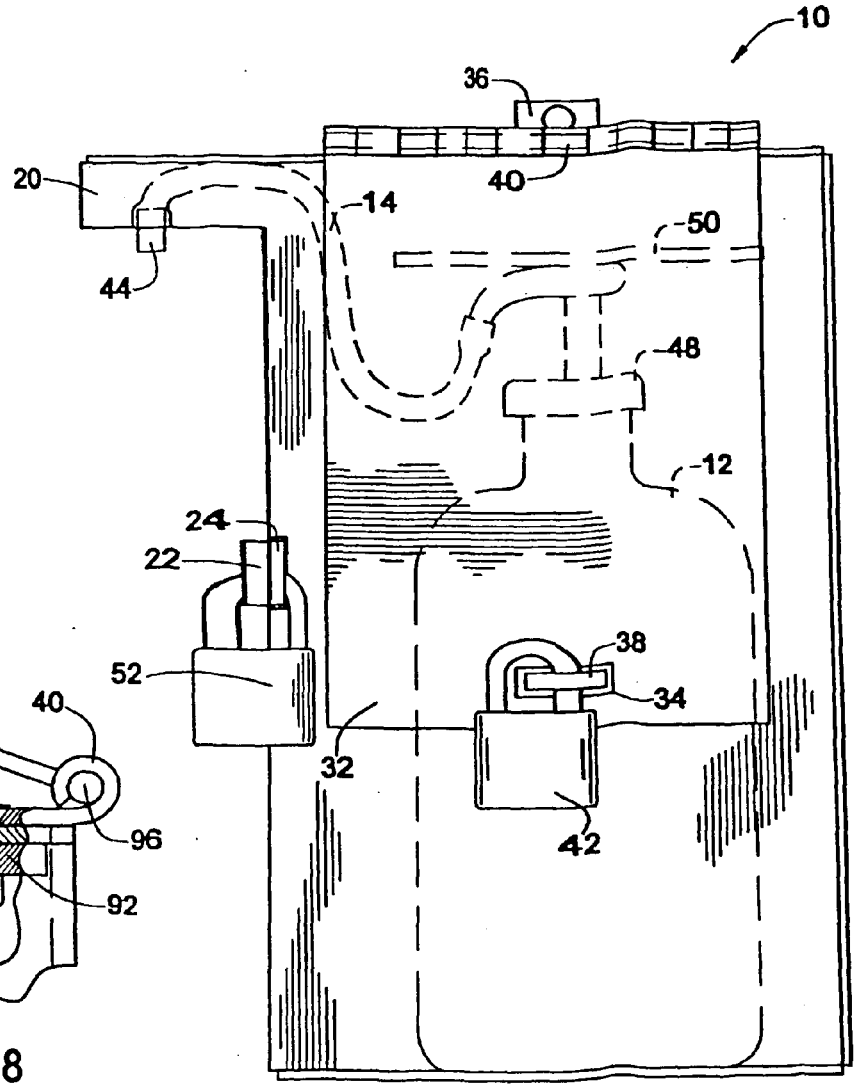
Figure 8:
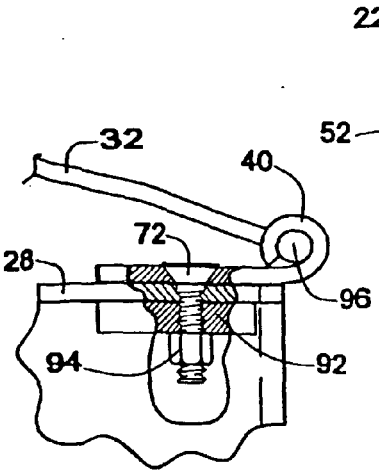
Figure 6:
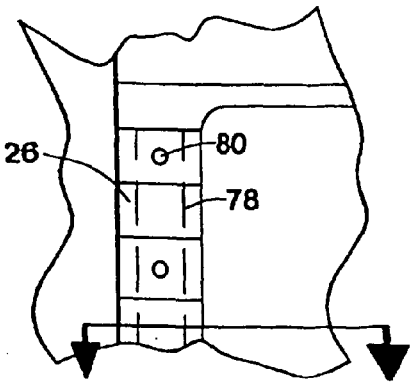
Figure 7:
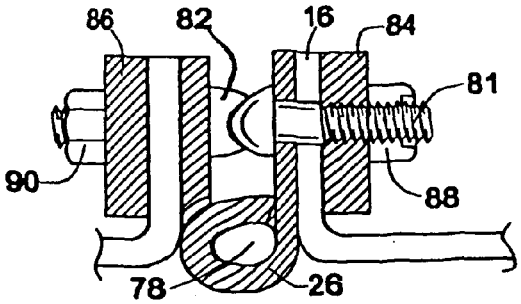
Figure 3:
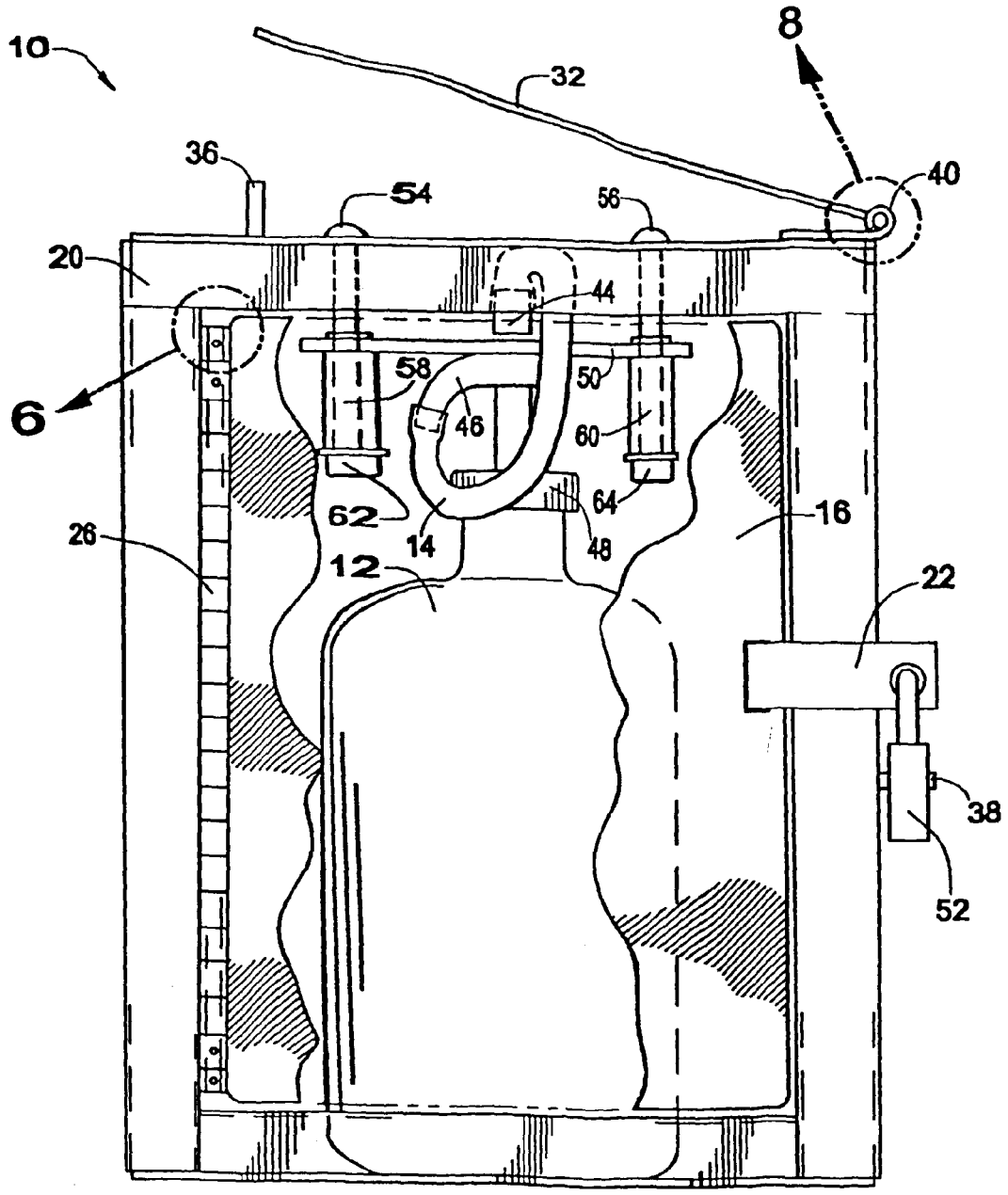
Figure 4:
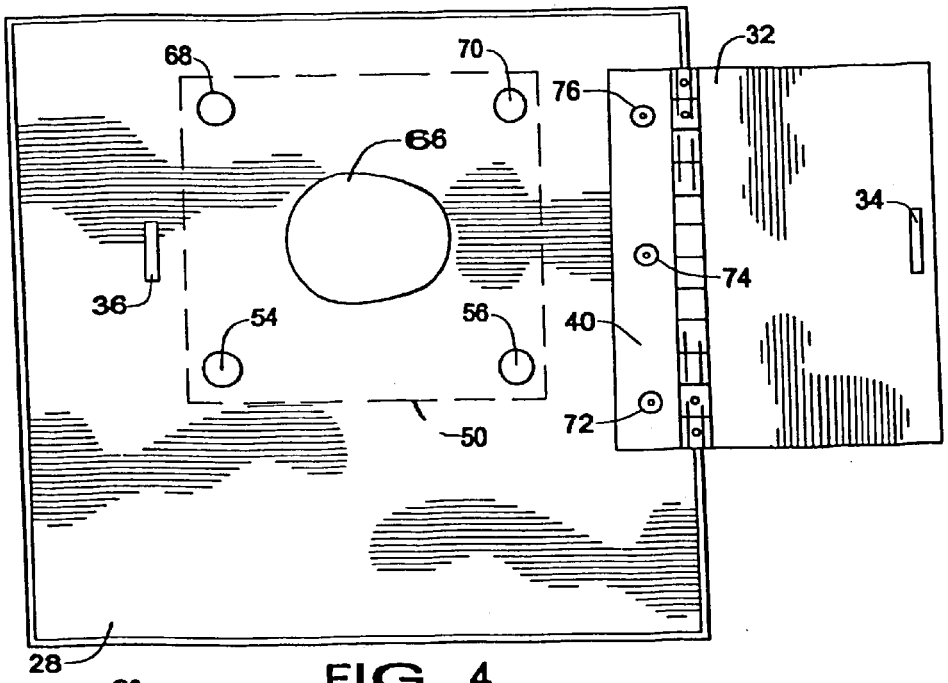
Figure 5:
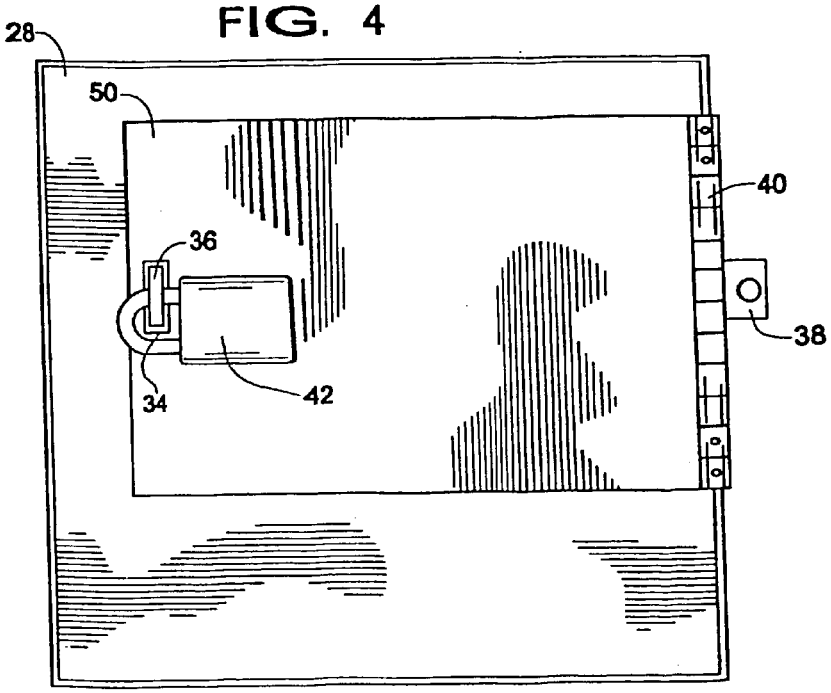
Figure 9:
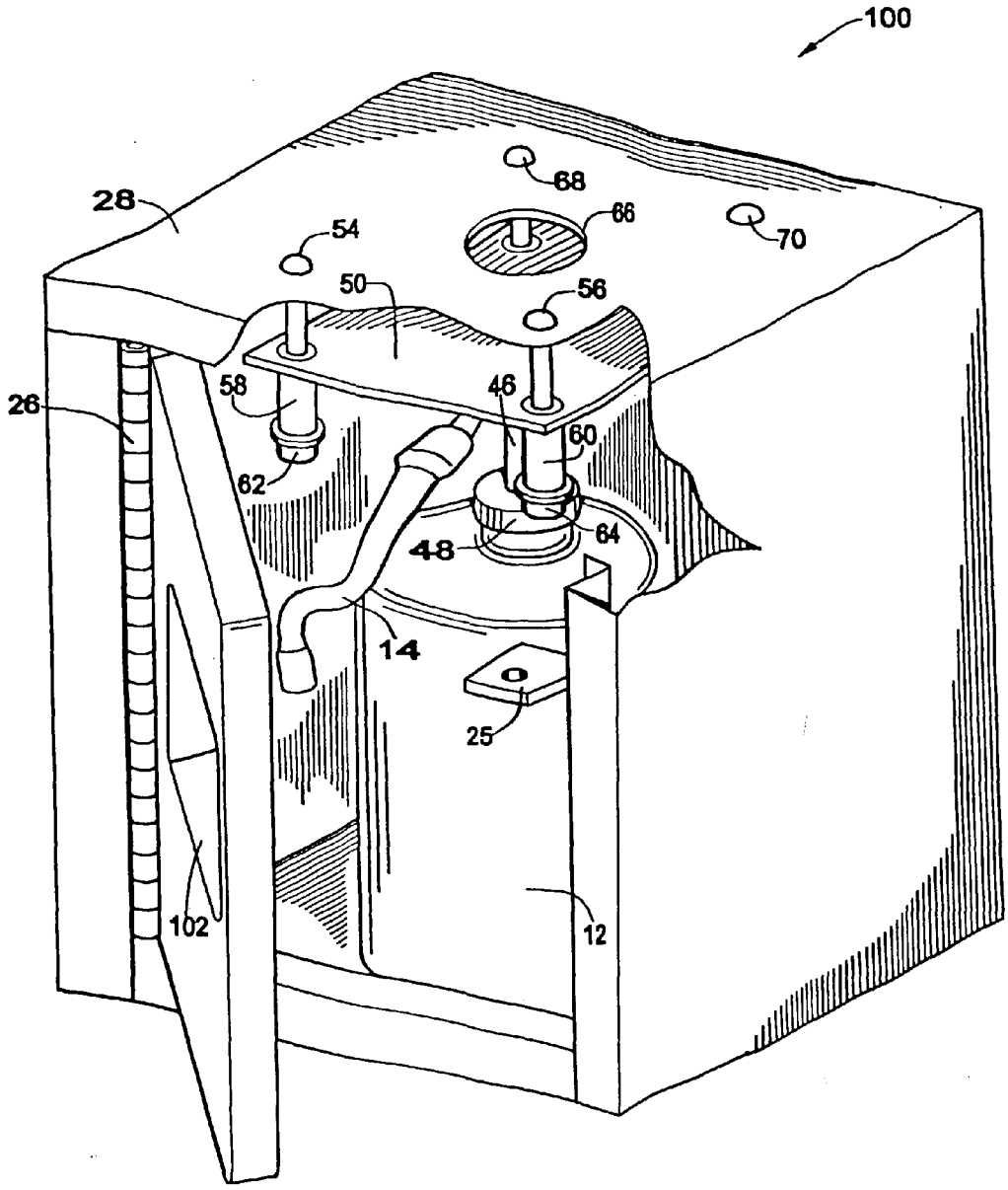
Figure 10:
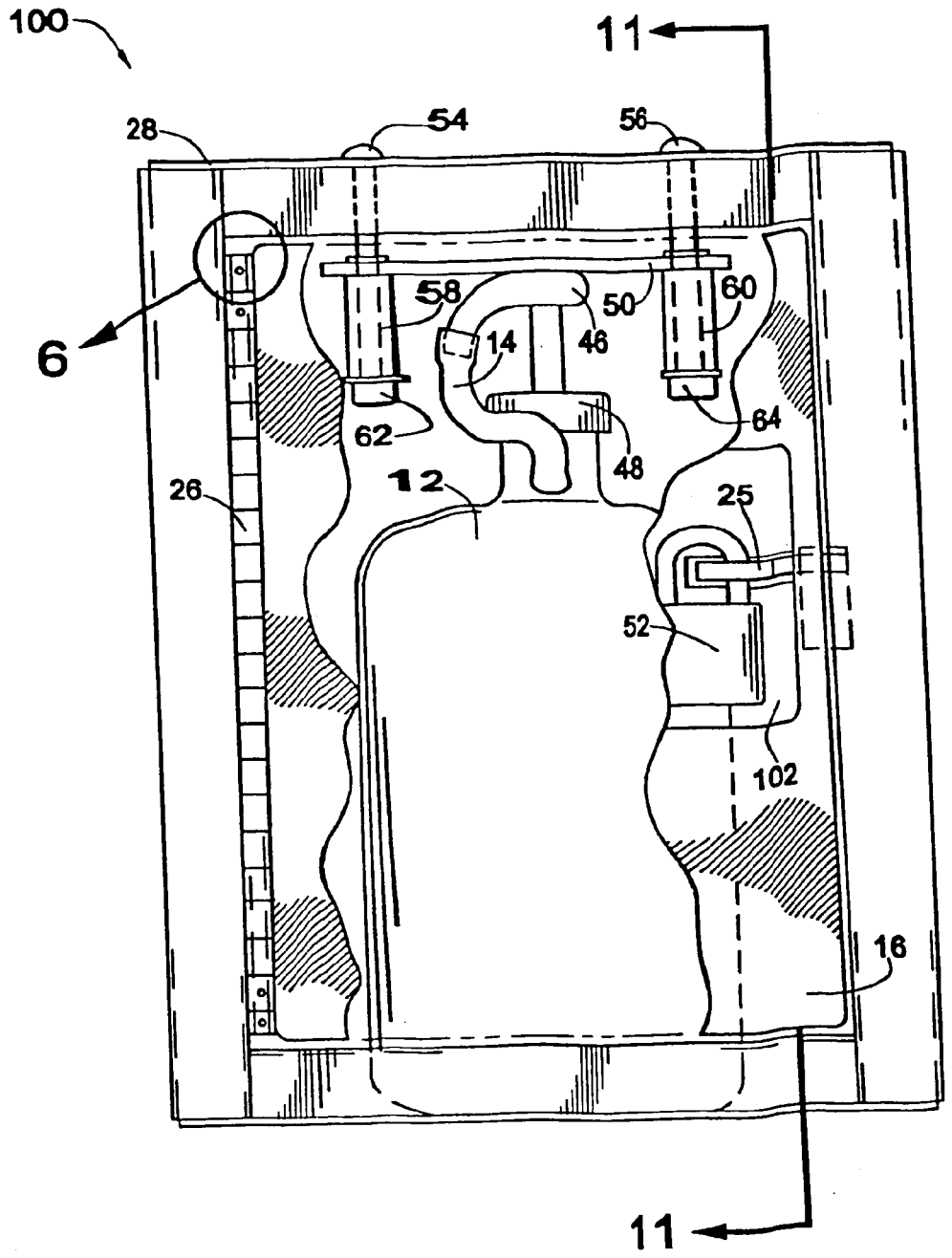
Figure 11:
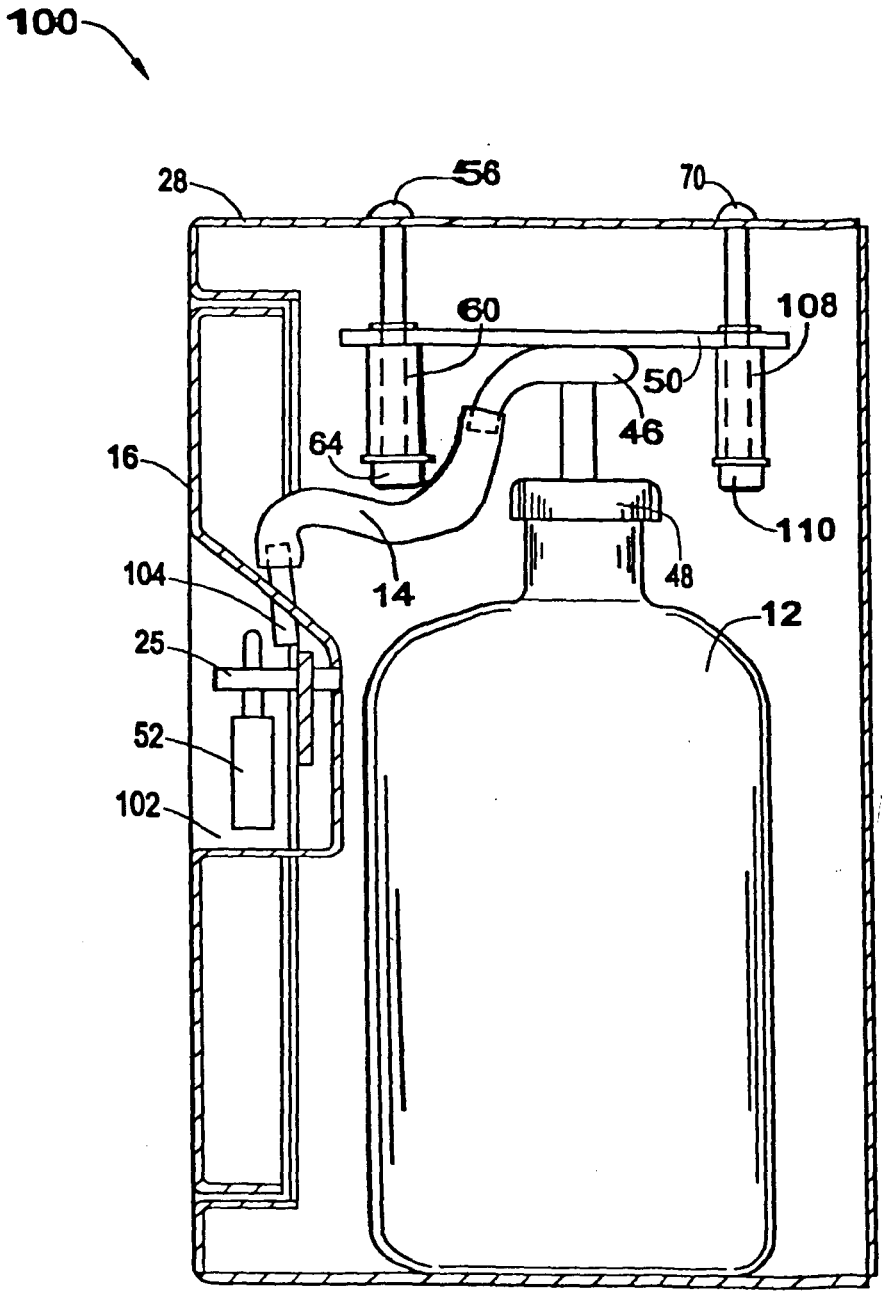
Figure 12:
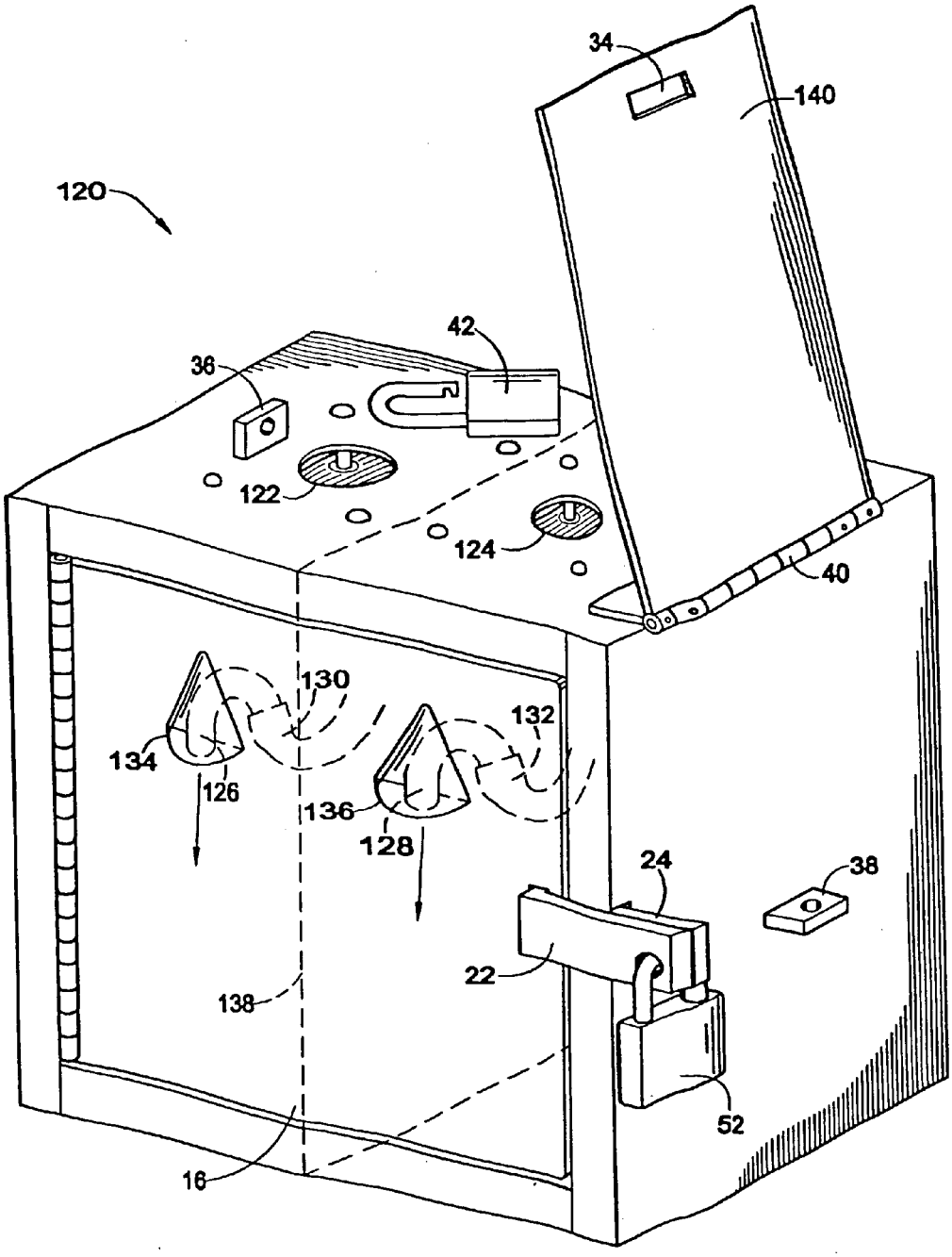
Figure 13:
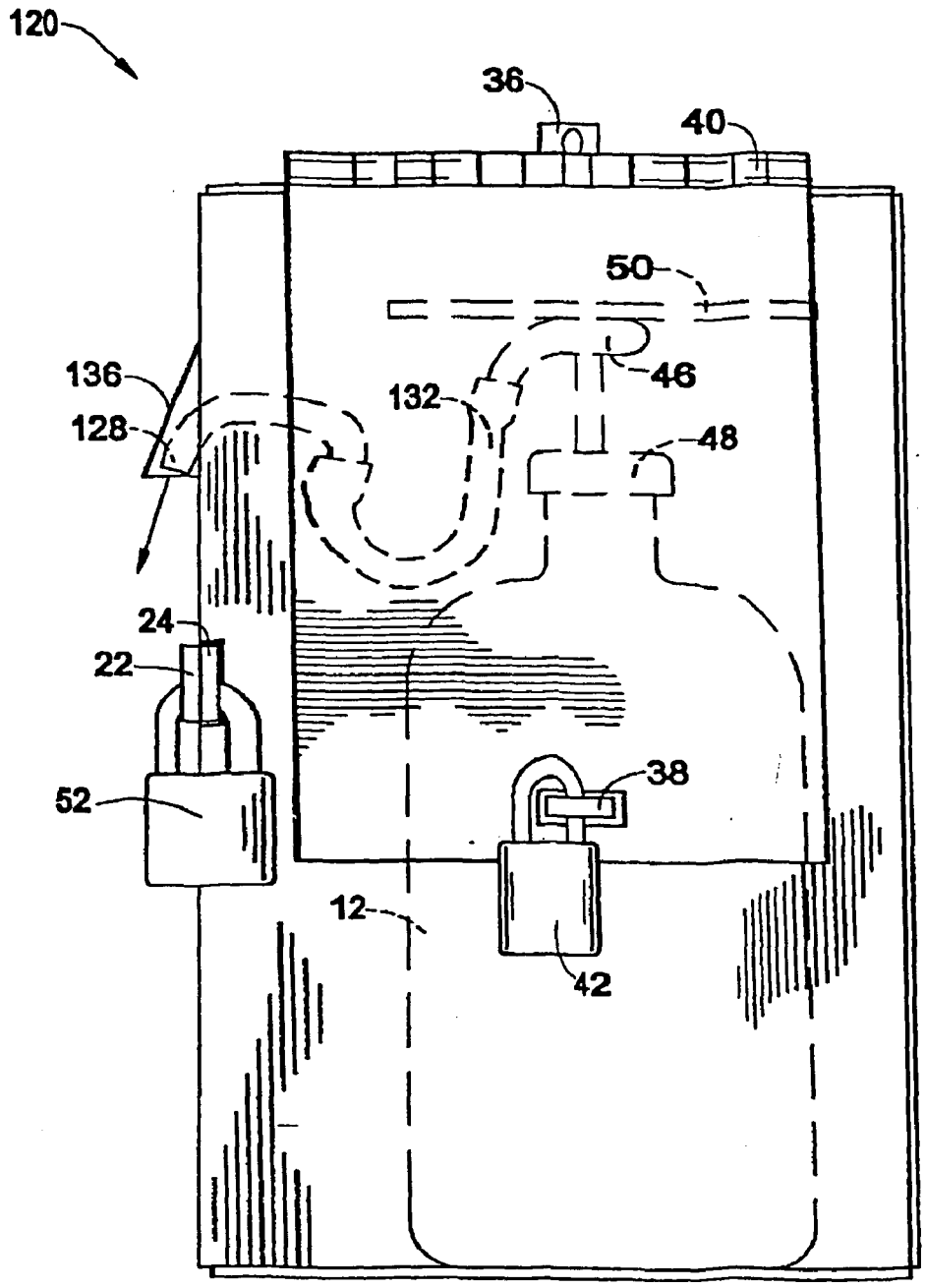
Figure 14:
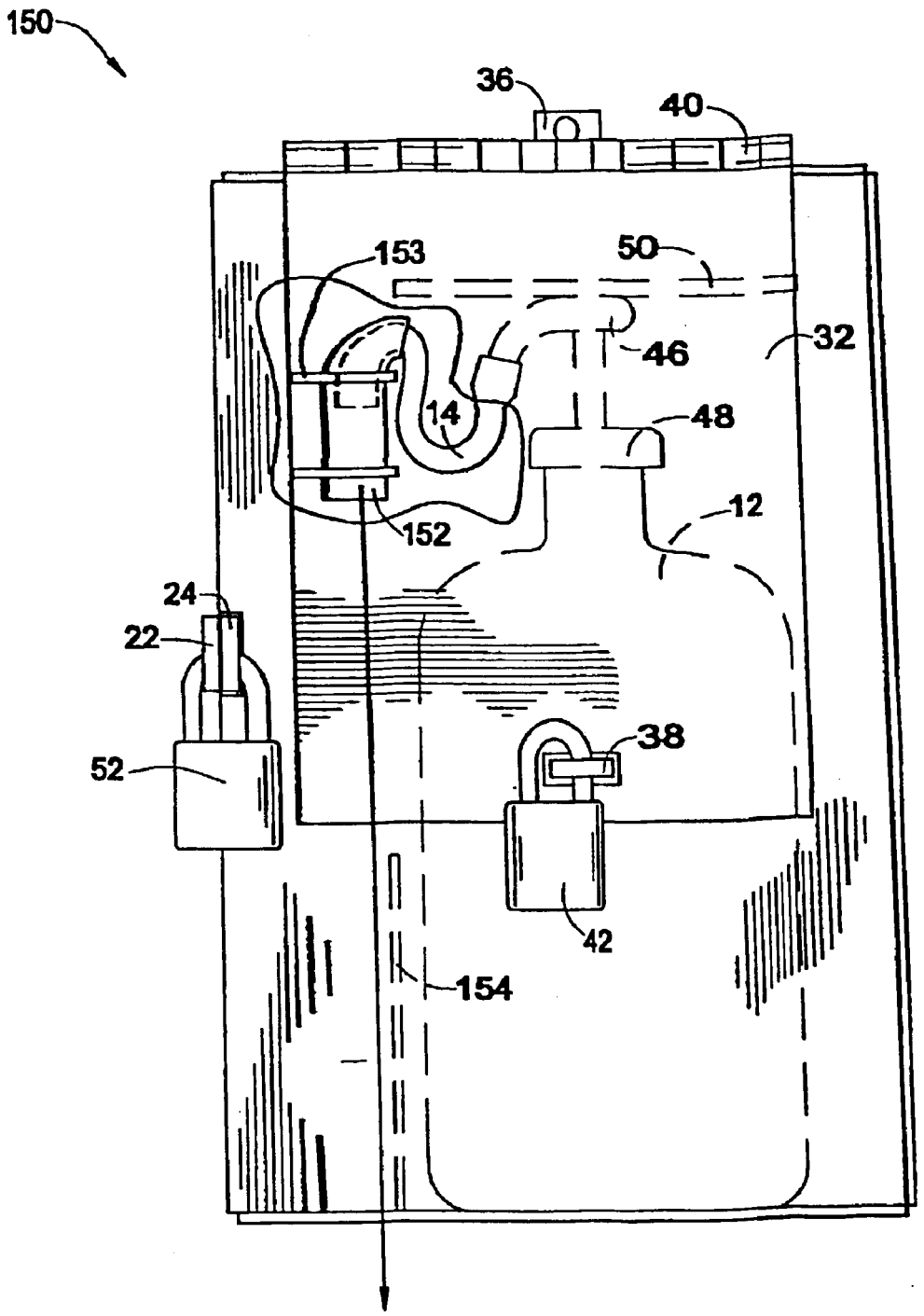
Figure 15:
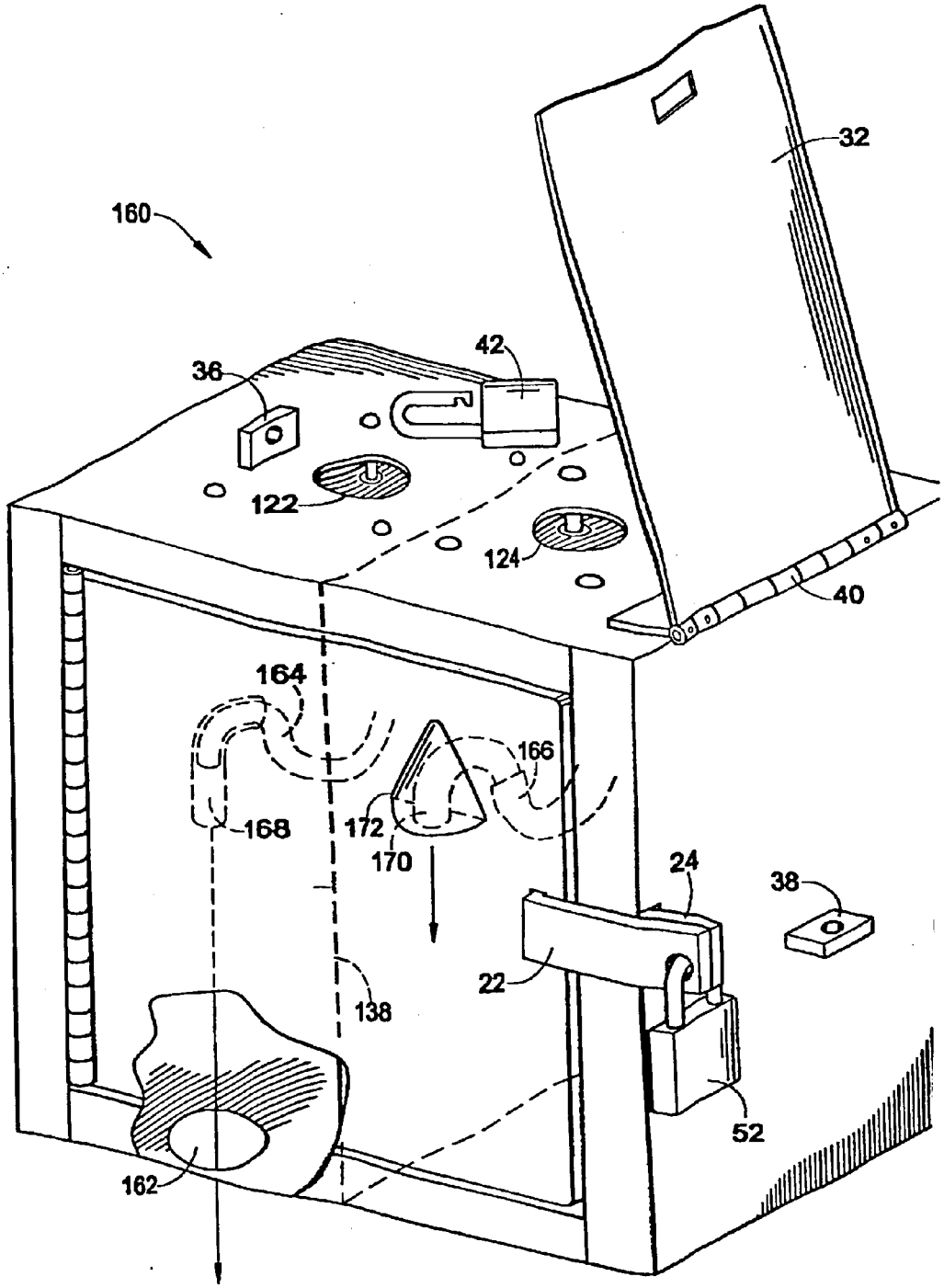
Figure 16:
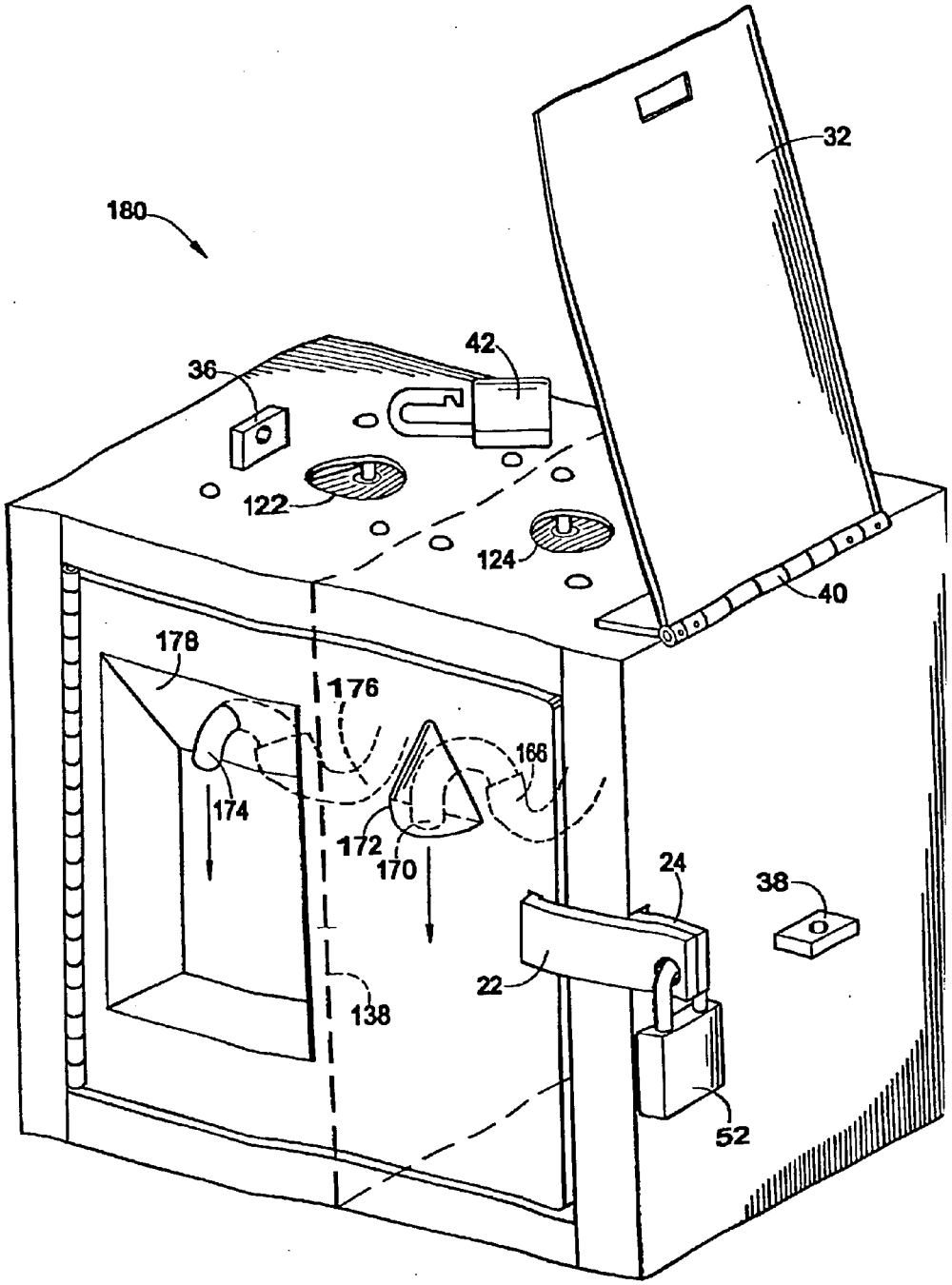

Referring to FIG. 16, shown is a perspective view of a combinational outlet dispensing unit 180 for use with a liquid, soap and other cleaning or chemical materials. Shown is the combination outlet dispensing unit 180, the first top hole 122, the second top hole 124, an outlet shield 172, a first outlet 174, a first outlet hose 176, a second outlet 170, a second outlet hose 166, the flap 140, the flap hinge 40, the flap lock 42, the top hasp 36, the side hasp 38, the door lock 52, the first door hasp 22, the second door hasp 24, a door indentation 178, the lockable door 16, and the inside panel 138.

Shown is the combination outlet dispensing unit 180 similar to the dual outlet dispensing unit 120 of FIG. 12. However, one side of the dual outlet dispensing unit 120 has been replace by the outlet system of FIG. 9. The combination outlet dispensing unit 180 has all the features described with reference to FIGS. 1 through 15. The first outlet 174 is the same as the outlet described in FIGS. 9 through 11, while the second outlet 170 and the outlet shield 172 are described in detail with reference to FIGS. 12 and 13. The flap 140 is also described with reference to FIG. 12.

The combination outlet dispensing unit 180 has the indentation 178 in the lockable door 16 with the first outlet 174 slightly angled toward the back of the indentation 178. The first outlet and indentation allow a user to fill up a container as long as it fits into the indentation, such as a hand held container. This prevents a user from filling up a large bucket from the first outlet 174. The indentation 178 is further described with reference to FIGS. 9 through 11. The combination outlet dispensing unit 180 could be used above a sink, such that the second outlet 170 is used for dish or hand soap that could drop directly into the sink and the first outlet 174 would be used to fill small containers.

While the invention herein disclosed has been described by means of specific embodiments and applications thereof, numerous modifications and variations could be made thereto by those skilled in the art without departing from the scope of the invention set forth in the claims.

What is claimed is:

1. A tamper-proof apparatus for dispensing a liquid comprising:

a chamber;

a lockable door making up at least a part of one side of the chamber;

a supply reservoir within the chamber;

a plunger coupled to the supply reservoir;

a hole in the chamber;

a plate coupled to the chamber;

an offset; and a plurality of screws coupled to the chamber and to the plate;

wherein the plate is within the chamber, such that if pressure is applied to the plate the plunger will be depressed;

wherein the offset controls the depth the plunger can be depressed;

wherein the offset, is a plurality of spacers coupled to the plurality of screws.

2. A tamper-proof apparatus for dispensing a liquid comprising:

a chamber;

a lockable door making up at least a part of one side of the chamber;

a supply reservoir within the chamber;

a plunger coupled to the supply reservoir;

a hole in the chamber;

a plate coupled to the chamber;

an indentation in the lockable door; and an outlet in the indentation in the lockable door;

wherein the plate is within the chamber, such that if pressure is applied to the plate the plunger will be depressed.

3. The apparatus of claim 2 wherein the indentation in the lockable door is shaped such that only hand held containers can be filled with the fluid.

4. The apparatus of claim 2 wherein the outlet is pointed toward a back of the indentation in the lockable door.

5. A tamper-proof apparatus for dispensing a liquid comprising:

a chamber for storing the liquid;

an outlet in the chamber for dispensing the liquid;

an outlet shield protecting the outlet from damage;

a hole in a top of the chamber;

a plate coupled to the chamber below the hole; and a plurality of spacers allowing the plate to be depressed a predetermined distance.

6. The apparatus of claim 5 wherein the outlet shield is in the shape of a nose guard.

7. The apparatus of claim 5 wherein the outlet shield is one piece of sheet metal welded to the chamber.

8. The apparatus of claim 5 further comprising:

a supply reservoir within the chamber for housing the liquid;

a plunger coupled to the supply reservoir; and an output tube coupled to the plunger and coupled to the outlet, such that the output tube is not accessible from outside the chamber.

9. The apparatus of claim 5 further comprising a plunger positioned below the plate.

10. The apparatus of claim 5 further comprising:

a lockable door making up one side of the chamber; and a lockable flap coupled to the top of the chamber.

11. The apparatus of claim 10 wherein the lockable flap can be locked to cover the hole in the top of the chamber.

12. A method of dispensing liquid from a dispensing unit comprising:

storing a liquid in a supply reservoir within a locked chamber;

applying pressure to a plate within the locked chamber through a hole in the locked chamber;

dispensing the liquid through an outlet in the locked chamber, the outlet being covered by an outlet shield to protect the outlet from damage; and locking a lockable flap such that pressure cannot be applied to the plate within the locked chamber.

13. The method of claim 12 further comprising filling a container with the liquid being dispensed from the locked chamber.

14. The method of claim 12 further comprising causing the liquid to flow through an output tube, wherein the output tube is coupled to the supply reservoir and coupled to the outlet.

15. The method of claim 14 wherein the output tube is not accessible from outside of the locked chamber.

16. The method of claim 12 wherein the output shield is in the shape of a nose guard.

17. A tamper-proof apparatus for dispensing a liquid comprising:

a chamber for storing the liquid;

an outlet in the chamber for dispensing the liquid;

an outlet shield protecting the outlet from damage;

a supply reservoir within the chamber for housing the liquid;

a plunger coupled to the supply reservoir;

an output tube coupled to the plunger and coupled to the outlet, such that the output tube is not accessible from outside the chamber;

a hole in the chamber;

a plate coupled to the chamber below the hole and above the plunger; and a plurality of spacers allowing the plate to be depressed a predetermined distance.

18. A tamper-proof apparatus for dispensing a liquid comprising:

a chamber for storing the liquid;

an outlet in the chamber for dispensing the liquid;

an outlet shield protecting the outlet from damage;

a lockable door making up one side of the chamber; and a lockable flap coupled to a top of the chamber;

a hole in the chamber; and a plate coupled to the chamber below the hole and above a plunger;

wherein the lockable flap can be locked to cover the hole in the chamber.

19. A tamper-proof apparatus for dispensing a liquid comprising:

a chamber;

a lockable door coupled to the chamber;

an outlet in the chamber;

a hole in the chamber;

a plate coupled to the inside of the chamber; and an offset for controlling the distance the plate can be depressed;

wherein the plate is accessible through the hole in the chamber.

20. The apparatus of claim 19 where the offset comprises a plurality of spacers.

21. The apparatus of claim 20 further comprising a plurality of screws coupled to the plurality of spacers.

22. The apparatus of claim 19 further comprising an outlet shield protecting the outlet from damage.

23. The apparatus of claim 19 further comprising a lockable flap coupled to the chamber;

wherein the lockable flap covers the hole in the chamber when the lockable flap is close.

24. The apparatus of claim 19 further comprising an indentation in the lockable door;

wherein the outlet is in the indentation in the lockable door.

25. A tamper-proof apparatus for dispensing a liquid comprising:

a chamber;

a lockable door coupled to the chamber;

an outlet in the chamber;

a plate coupled to the inside of the chamber;

an offset for controlling the distance the plate can be depressed;

a hole in the chamber; and a lockable flap coupled to the chamber;

wherein the lockable flap covers the hole in the chamber when the lockable flap is closed;

wherein the plate is accessible through the hole in the chamber.

26. The apparatus of claim 25 wherein the offset comprising a plurality of spacers.

27. The apparatus of claim 26 further comprising a plurality of screws coupled to the plurality of spacers.

28. A tamper-proof apparatus for dispensing a liquid comprising:

a chamber;

a lockable door coupled to the chamber;

an indentation in the lockable door;

an outlet in the chamber;

a hole in the chamber; and a lockable flap coupled to the chamber;

wherein the lockable flap covers the hole in the chamber when the lockable flap is closed;

wherein the outlet is in the indentation in the lockable door.

29. A tamper-proof apparatus for dispensing a liquid comprising:

a chamber;

a lockable door coupled to the chamber;

an indentation in the lockable door;

an outlet in the indentation in the lockable door; and a lock coupled to the chamber within the indentation in the lockable door.

* * * * *

UNITED STATES PATENT AND TRADEMARK OFFICE

CERTIFICATE OF CORRECTION

PATENT NO. : 6,612,467 B2
DATED : September 2, 2003
INVENTOR(S) : Wertheim, Mark S.

It is certified that error appears in the above-identified patent and that said Letters Patent is hereby corrected as shown below:

Please replace drawing sheets 1-9 (Figures 1-12) with replacement drawing sheets 1-8 (Figures 1-12).

Attachment: Eight (8) replacement drawing sheets

Signed and Sealed this

Twenty-fourth Day of August, 2004

JON W. DUDAS
*Director of the United States Patent and Trademark Office*